US005974286A

United States Patent [19]

Ban et al.

[11] Patent Number: 5,974,286

[45] **Date of Patent: *Oct. 26, 1999**

[54] TONER SUPPLY CONTAINER AND A TONER SUPPLY MECHANISM HAVING A TONER SUPPLY CONTAINER, TO BE SET TO A HOPPER OPENING OR TO A SUPPLY PORTION HAVING A HOPPER OPENING

[75] Inventors: Yutaka Ban, Tokyo; Kyota Miyazaki; Ken Wakatsuki, both of Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/736,597

[22] Filed: Oct. 24, 1996

[30] Foreign Application Priority Data

Oct. 26, 1995 [JP] Japan ..... 7-279017

[51] Int. Cl.[6] ..... G03G 15/08

[52] U.S. Cl. ..... 399/106; 222/DIG. 1; 399/258; 399/262

[58] Field of Search ..... 399/106, 258, 399/260, 262; 222/DIG. 1; 141/363–366

[56] References Cited

U.S. PATENT DOCUMENTS

| | | | |
|---|---|---|---|
| 4,589,579 | 5/1986 | Morita | 222/561 |
| 4,834,246 | 5/1989 | Inoue et al. | 206/631 |
| 4,895,104 | 1/1990 | Yoshino et al. | 222/DIG. 1 |
| 4,931,838 | 6/1990 | Ban et al. | 399/106 |
| 5,018,560 | 5/1991 | Tsukamoto | 141/364 |
| 5,513,679 | 5/1996 | Yamada | 141/364 |

FOREIGN PATENT DOCUMENTS

| | | |
|---|---|---|
| 0 514 168 A2 | 11/1992 | European Pat. Off. . |
| 0 102 002 | 3/1994 | European Pat. Off. . |
| 3-36565 | 2/1991 | Japan . |
| 7-20681 | 4/1995 | Japan . |

*Primary Examiner*—William Royer

*Attorney, Agent, or Firm*—Fitzpatrick, Cella, Harper & Scinto

[57] ABSTRACT

A toner supply container to be set to a supply portion having a hopper opening for a toner hopper, a hopper shutter member for opening and closing the hopper opening, and a lock for locking the hopper shutter member. The container includes a toner container body for accommodating toner and having a supply opening for supplying the toner, a seal member for sealing the supply opening, a releasing projection for releasing locking of a hopper shutter member by the lock, in response to setting operation to the supply portion; and an interrelating device for interrelating movement of the hopper shutter member and the seal member when the container is set to the supply portion.

20 Claims, 16 Drawing Sheets

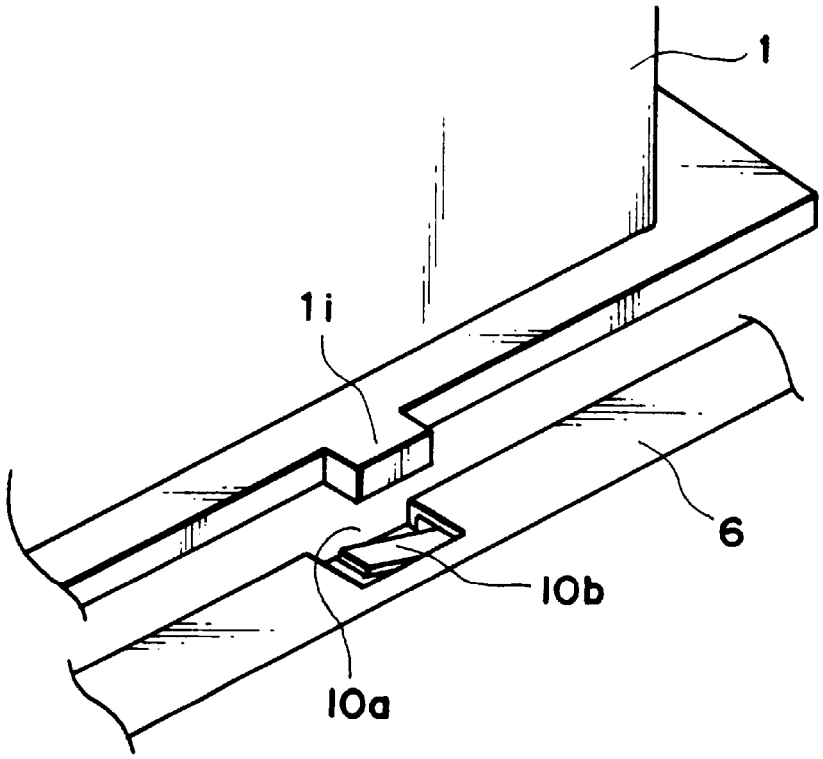
FIG. 13
FIG. 14a
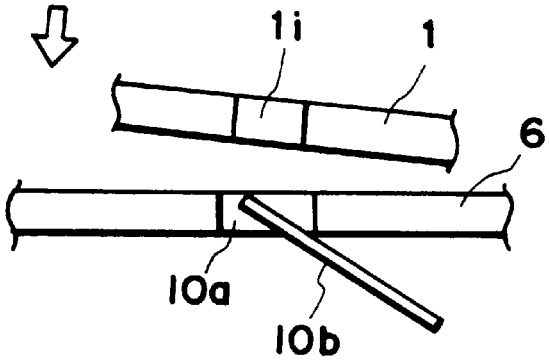
FIG. 14b
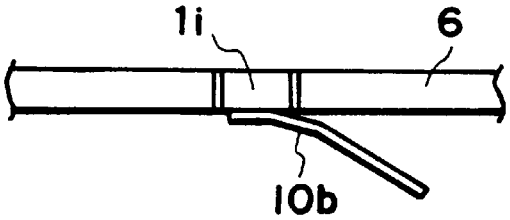

TONER SUPPLY CONTAINER AND A TONER SUPPLY MECHANISM HAVING A TONER SUPPLY CONTAINER, TO BE SET TO A HOPPER OPENING OR TO A SUPPLY PORTION HAVING A HOPPER OPENING

FIELD OF THE INVENTION AND RELATED ART

The present invention relates to a mechanism for supplying toner to the toner hopper of an image forming apparatus, such as a copying machine or a printer, and also relates to a toner supply container to be used to fill toner into the toner hopper.

Conventionally, toner in the form of powder is employed as developer in an image forming apparatus such as an electrostatic copying machine or a printer. As the toner in the main assembly of the image forming apparatus is consumed, a fresh supply of toner is refilled into the apparatus main assembly, using a toner supply container.

Toner supply containers, which have been widely used, generally comprise an actual container portion in the form of a box, a flange, and a flexible film (hereinafter, sheet film). The flange is integrally formed with the actual container portion, and the flexible film is separably adhered to the flange by means, such as thermal welding or the like. However, it is practically not possible to completely empty such a toner supply container; a small amount of toner, which is liable to be spilled and scattered, remains in a used toner supply container.

In order to eliminate the liability described above, Japanese Laid-Open Patent Application No. 336565 proposes a toner supply container provided with a shutter, which enables the container to be resealed, and such a toner supply container is being practically used.

The toner from the aforementioned toner supply container is received by a toner hopper or a developing device provided on the main assembly side of a copying machine. Some of the hoppers or development devices are provided with a shutter (hereinafter, hopper lid) to prevent toner from scattering and soiling the apparatus, or to prevent toner mix-up caused by the insertion of a wrong toner supply container. Further, in order to prevent the user from mistakenly opening the hopper lid, some of the hoppers are provided with a locking mechanism. For example, according to the proposal in Japanese Laid-Open Utility Model Application No. 20681/1995, unlocking of such a locking mechanism is linked with the operation for mounting the toner supply container and peeling the aforementioned seal film.

However, the toner supply containers and the hoppers described above have the following problems. In the case of the mechanical arrangement proposed in Japanese Laid-Open Utility Model Application No. 20681/1995, the operation for peeling the seal film causes the movement of a sliding member, the unlocking of the hopper lid, and the movement of the hopper lid, to occur at the same time. Therefore, the force necessary for the operation increases, which reduces operational efficiency. Further, all the force applied to remove the seal film ultimately acts on the seal film itself, and therefore, trouble such as partial or complete tearing of the seal film occur more frequently.

SUMMARY OF THE INVENTION

Accordingly, a primary object of the present invention is to provide a toner supply container with superior toner filling efficiency.

Another object of the present invention is provide a toner supply container which requires a smaller amount of force to operate so that breakage of the sealing film can be prevented.

Another object of the present invention is to provide a toner refilling system comprising: a toner hopper for storing toner, an opening through which toner is refilled, a shutter member for exposing or covering the opening, locking means for locking the shutter member, a toner supply container to be fitted in the opening, being provided with a sealing member for sealing the joint between the opening of the toner supply container and the opening of the toner hopper opening, lock disengaging means, which is caused to unlock the toner hopper as the toner supply container is fitted with the toner hopper, and a linkage which moves together the sealing member and the shutter member after the toner supply container is fitted and the toner hopper, locked by the locking means, is unlocked.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 13 is a perspective view of a pop-up mechanism.

FIGS. 14(*a*) and 14(*b*) are sectional views of the movements of the pop-up mechanism.

DESCRIPTION OF THE PREFERRED EMBODIMENTS

Hereinafter, the preferable embodiments of the present invention will be described with reference to the drawings.

[Structure of Toner Supply Container]

Figure 1:
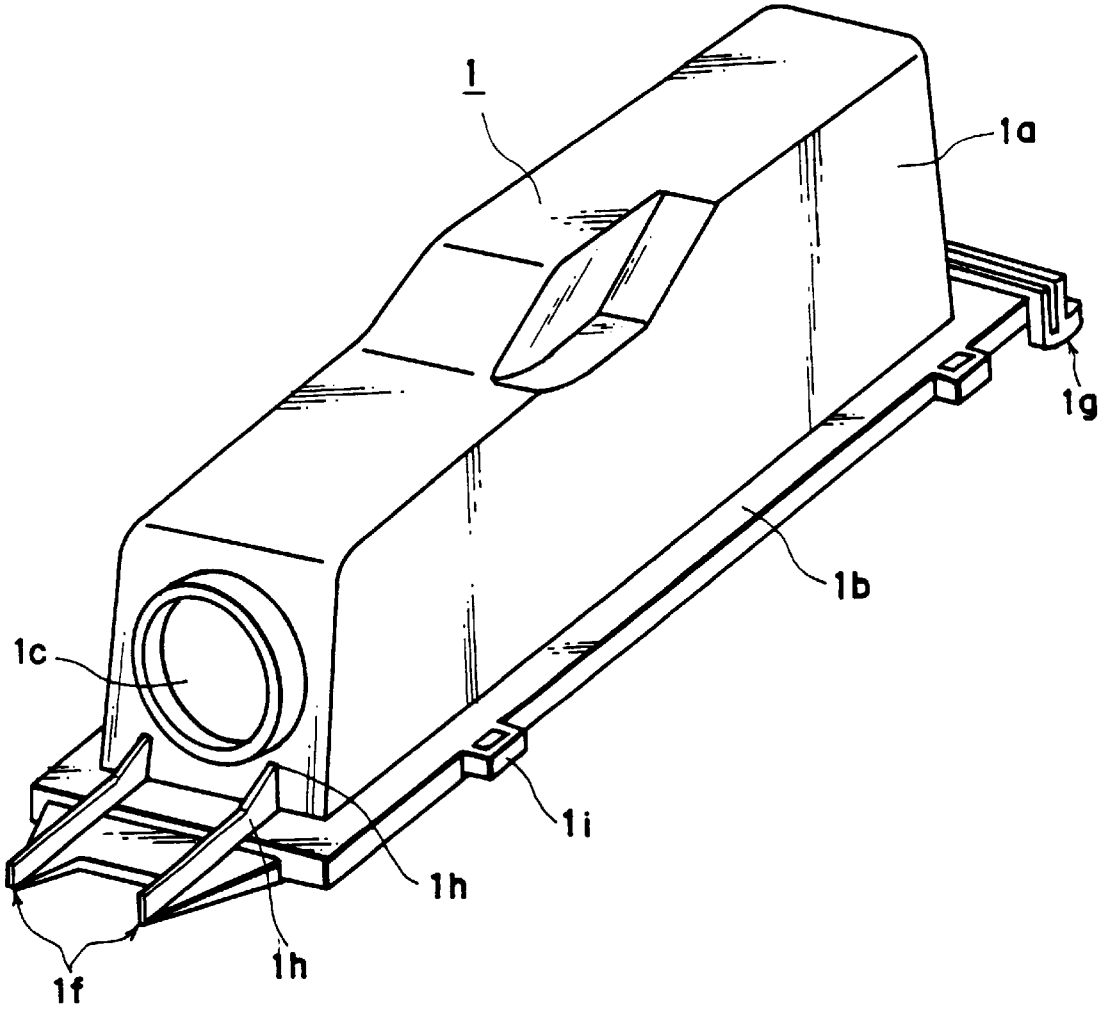
FIG. 1 is a perspective view of the main body of the toner supply container in an embodiment of the present invention.
Figure 2:
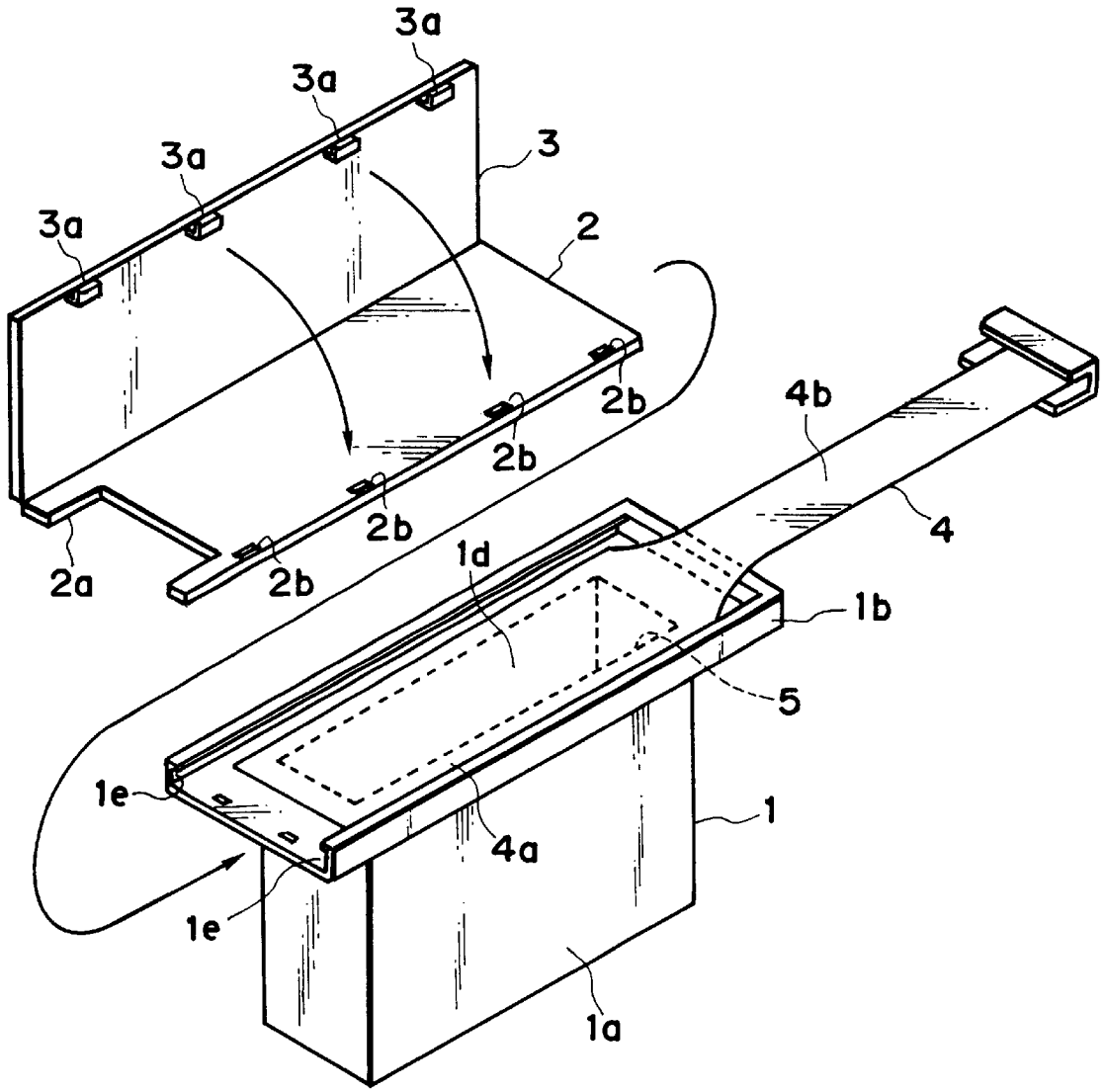
FIG. 2 is an exploded perspective view of the toner supply container in the embodiment of the present invention, depicting how the container is assembled.
Figure 3:
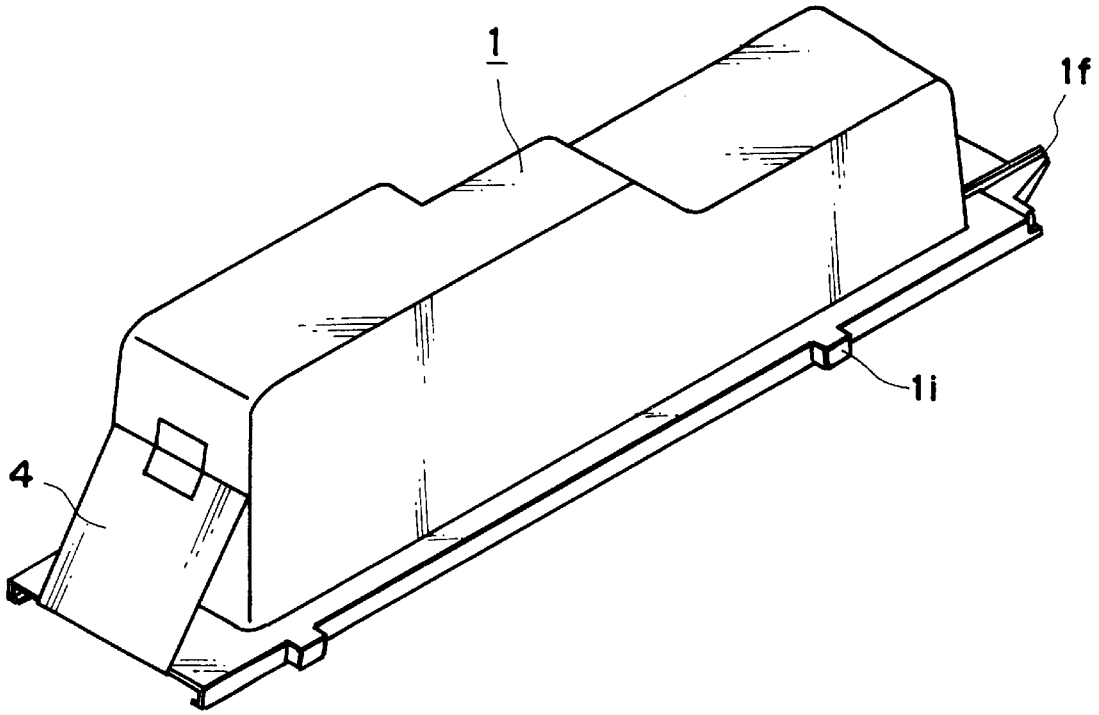
FIG. 3 is a perspective view of the completely assembled toner supply container in the embodiment of the present invention.
Figure 4:
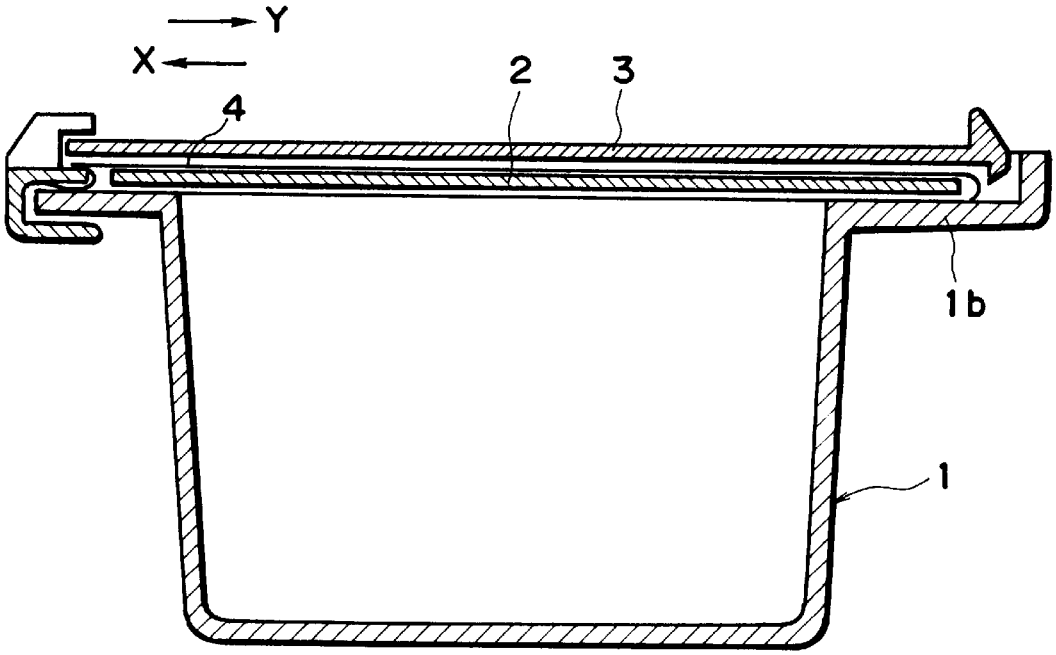
FIG. 4 is a sectional view of the toner supply container in the embodiment of the present invention.
Figure 5A:
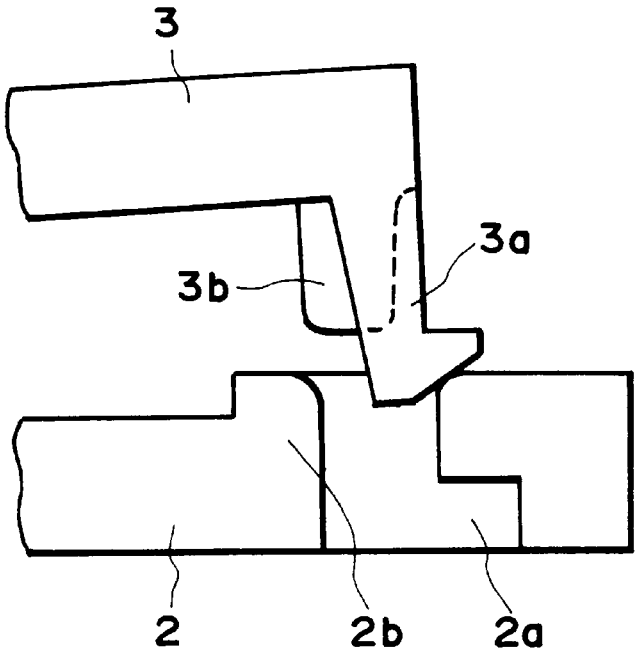
FIGS. 5(*a*) and 5(*b*) are enlarged sections of the joint portion between the top and bottom pieces of the shutter.
Figure 5B:
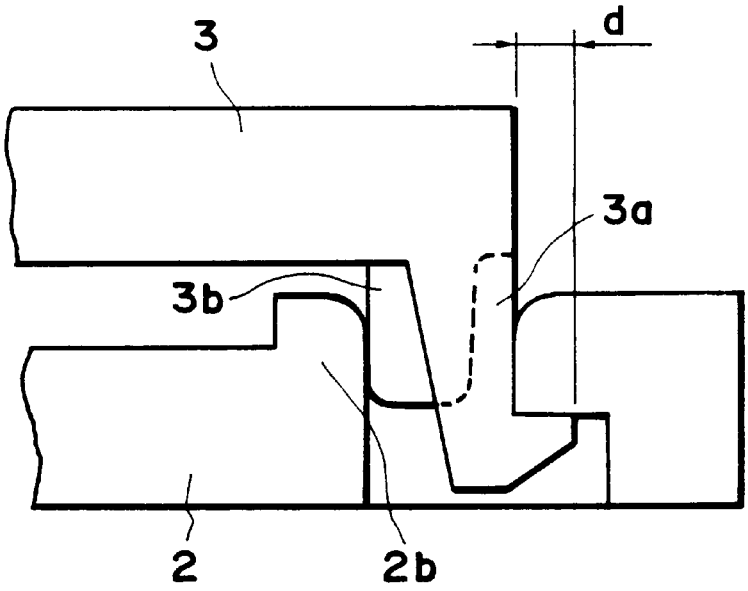

FIG. 1 is a perspective view of the main portion of the toner supply container in an embodiment of the present invention, and FIG. 2 is an exploded perspective view of the same toner supply container, depicting how the container is assembled. FIG. 3 is a perspective view of the completely assembled toner supply container, and FIG. 4 is a section of the toner supply container. FIG. 5 is an enlarged section of the joint between the top and bottom pieces of a shutter. In FIGS. 1–4, a reference numeral 1 designates the main portion of the toner supply container; 2 designates the top piece of a shutter; 3 denotes the bottom piece of the shutter: 4 denotes a seal film; and reference numeral 5 designates a cap.

The container main portion 1 comprises a toner storing portion 1*a* in the form of a box, and flange portion 1*b* integrally formed with the toner storing portion 1*a*. The toner storing portion 1*a* is provided with a toner filling opening 1*c*, and the flange portion 1*b* is provided with an opening 1*d* (toner discharging opening) for discharging the toner. In order to seal the toner discharging opening 1*d*, a seal film 4 (4*a*) is separably adhered to the flange portion 1*b*. Also, the flange portion 1*b* is provided with a U-shaped guide portion 1*e*, along which the top piece 2 of the shutter is inserted to be retained there. One end of the seal film 4 is folded back in a manner to wrap around the top piece 2 of the shutter, and is extended to the front side. The bottom piece 3 of the shutter is joined with the top piece 2 of the shutter in a manner to enclose the folded portion 4*b* of the seal film 4, completing a toner supply container. The completed toner supply container is filled with a predetermined amount of toner, and the cap 5 is pressed into the toner filling opening 1*c*.

A projection 1*f* for disengaging a first lock is integrally formed with the back end of the main portion of the toner supply container, and a projection 1*g* for disengaging a second lock is integrally formed with the lateral edges of the front side of the flange portion.

[Toner Supply Container Manufacturing Method]

The toner supply container main portion 1 integrally comprising the toner storing portion 1*a* and the flange portion 1*b* is formed of, for example, impact resistant polystyrene resin (HI-PS), by injection molding. As will be described later, the toner supply container main portion 1 requires a certain degree of rigidity so that projections 1*f* and 1*g* can unlock the locked toner hopper, or the guide portion 1*e* can retain the top piece 2 of the shutter. Also, it is required to withstand various vibrations and impacts which occur during the transportation of the container, or when it is dropped. Further, the toner supply container main portion 1 is required to have a proper amount of wettability so that the seal film 4 can be separably adhered thereto. In order to satisfy all the requirements described above, the aforementioned HI-PS is most suitable. However, synthetic resins such as acrylonitrile-styrene-butadiene copolymer resin (ABS) or polyphenylene oxide resin (PPO) may be preferably employed in addition to the HI-PS. Also, it is possible to use various other materials such as metal, wood, or paper.

As for the manufacturing method for the toner supply container, injection molding is most suitable because it allows more latitude in terms of the thickness (being thin) of the container wall, and in terms of the shape of the container. However, vacuum molding, compression molding, blow molding, or the like method, may be optionally selected depending on the choice of material.

The top piece 2 and bottom piece 3 of the shutter need rigidity for retaining the seal film 4 against the internal pressure generated while the toner supply container is transported-or stored, and also elasticity for allowing the snap fit structure, which will be described later, to properly function. In order to satisfy the above requirements, it is also most desirable to form the top and bottom pieces 2 and 3 of the shutter, using the HI-PS and injection molding. However, other synthetic resins and other manufacturing methods may be preferably used in the same manner as they are in forming the toner supply container main portion.

It is most desirable that the top and bottom pieces 2 and 3 of the shutter are joined by snap fitting, which makes it simpler to assemble the toner supply container. However, thermal crimping and ultrasonic crimping, as well as a method in which bosses are pressed into a corresponding hole, may be preferably used. Also, the top piece 2 and bottom piece 3 of the shutter may be integrally formed as two pieces joined by a thin portion, which functions like a hinge. In this case, the top piece 2 and bottom piece 3 of the shutter have to be joined by one of the various methods described above, only at the end opposite to the thin portion.

[Detailed Structure of Toner Supply Container]

[First Lock Disengagement Projection 1*f*]

A pair (right and left) of projections 1*f* are provided at the back end of the toner supply container main portion 1. As will be described-later, this projection if disengages the first lock member 8 of a toner hopper 6 by pushing the lock member 8 upward. While the toner supply container is in engagement with the toner hopper, the projection 1*f* remains under the constant downward pressure from the lock member, and transmits this pressure to the flange portion 1*b* so that the bottom surface of the flange portion 1*b* is placed airtightly in contact with the hopper 6.

Therefore, it is desirable that the projection 1*f* is given a cross-section in the form of an inverted T as shown in the drawing depicting this embodiment. This is because the cross-section in the form of an inverted T gives the projection 1*f* rigidity, or deformation resistance, and also prevents the projection 1*f* from being broken by the impact which might occur when the toner supply container happens to be dropped while it is transported. However, other cross-sectional configurations such as L-shape, an I-shape, an H-shape, a U-shape, or the like, are also acceptable as long as they provide the projection 1*f* with sufficient rigidity, and resistance to the impact from falling. Further, it is desirable that the bent portion of the projection 1*f*, and the base portion 1*h* of the projection 1*f*, are provided with a sufficient degree of R, that is, at least R5, preferably, no less than R20.

The first lock disengagement projection 1*f* functions to place the lateral edges of the toner supply container airtightly in contact with the hopper by receiving the downward pressure. Therefore, it is most desirable that the projection 1*f* is provided on the right and left sides as it is in this embodiment, but only one, or three or more, may be provided. As for the position of the projection 1*f*, it is preferably closer to a pop-up projection 1*i*, which will be described later, though the position is optional.

[Second Lock Disengagement Projection 1*g*]

The second lock disengagement projection 1*g* is integrally formed with the front side of each lateral edge of the flange portion. As will be described later, this projection 1*g* disengages the second lock member of the hopper lid by pushing it frontward. Further, it plays a role in securely holding together the toner supply container and the toner hopper so that they can be prevented from being separated while the toner supply container and the hopper lid are open.

This projection 1*g* is preferably provided on the lateral edges of the flange portion 1*b* in order to prevent the seal film 4, and the top and bottom pieces 2 and 3 of the shutter which follow the movement of the seal film 4, from being pulled out. Further, in order to securely hold the toner supply container, it is desirable that the projection 1*g* is provided on the right and left sides of the toner supply container, though the number and positioning of the projection 1*g* are optional as long as they can provide the same functions as those provided in this embodiment.

As for the configuration of the projection 1*g*, it is dependent on the configuration and operation of the lock member on which it acts, but it is desirable that the bottom side of the projection 1*g* is given an R-shape, or is slanted, so that it can guide itself into the locking member, and the top side of the projection 1*g* is given a flat area as the surface by which the toner supply container is securely held.

In order to prevent the projection 1*g* from being damaged by the impact resulting from being dropped during the transportation, the corner portions or the base portions of the projection 1*g* are also desired to be given the same rounding treatment as the aforementioned projection 1*f* on the back side.

[Ceiling Side Configuration of Toner Supply Container]

As for the ceiling side configuration of the toner supply container main portion 1, it is rendered lower on the side of the first lock disengagement projection 1*f*, and higher on the side of the second lock disengagement projection 1*g*. The role of this configuration will be described later, but this configuration is generally effective to prevent the toner from heaping up as it is discharged into the hopper.

[Configuration of Guide Portion 1*e* (in the Form of Comb Teeth)]

The flange portion 1*b* of the toner supply container main portion 1 is provided with a substantially U-shaped guide portion 1*e*. The top piece 2 of the shutter is inserted along this guide portion 1*e*, and held therein.

The greater the depth of the valley portion (the depth in the width direction of the shutter) of the U-shaped guide portion 1*e*, the more securely can the shutter be retained. However, as it becomes greater, the force necessary to slide the top piece 2 of the shutter increases, making it difficult to open the shutter, and also, rendering the valley portion deeper interferes with size reduction. On the contrary, when the guide portion 1*e* is too shallow, the top piece 2 of the shutter is liable to come off while it is slid, and also is liable to fall off due to the impact resulting from falling, or due to an increase in internal pressure, during transportation. Further, as will be described later, the bottom surface of the guide portion 1*e* also constitutes a sealing surface which plays a role in keeping the toner supply container and the hopper airtightly connected. In order to effectively play this role, the guide portion 1*e* needs to have a proper depth, that is, the valley portion of the U-shaped must have a proper depth. In order to satisfy the above requirements, it is desirable that the depth of the valley portion of the U-shape is no less than 1 mm and no more than 3 mm, and it is most desirable that the depth is substantially 2 mm.

The width of the U-shaped portion (the dimension in the direction of the shutter thickness) is set in accordance with the thickness of the portion of the top piece 2 of the shutter, which engages with the U-shaped groove of the guide portion 1*e*. When it is too great relative to the thickness of the top piece 2 of the shutter, the fit between the top piece 2 of the shutter and the guide portion 1*e* becomes too loose, allowing the shutter to fall off, and also, the effectiveness of the shutter is reduced in backing up the seal film 4 against the drop impact and internal pressure increase, during transportation. On the contrary, when the difference between the thickness of the shutter and the width of the U-shaped portion is insufficient, the force necessary to slide the shutter may become extremely large due to component warpage or the like, which occurs during the formation of the toner supply container, and therefore, problems might occur when unsealing the container.

Because of the aforementioned reasons, it is most desirable that the width of the U-shaped portion is set to be 0.1 mm to 0.5 mm greater than the thickness of the engaging portion of the top piece 2 of the shutter, and also it is most desirable that the width of the U-shaped portion is set to be approximately 0.3 mm greater than the thickness of the engaging portion of the top piece 2 of the shutter.

The guide portion 1*e* may continuously extend across the entire length of the toner supply container, but it is preferable that the guide portion 1*e* is constituted of separate sections disposed, with intervals, across the entire length of the toner supply container.

The provision of intervals between the separate pieces of the guide portion 1*e* is effective to reduce the contact area between the top piece 2 of the shutter and the guide portion 1*e*, and therefore, to reduce the force necessary to slide the top piece 2 of the shutter.

Further, when the guide portion 1*e* is constituted of a single continuous piece, there is a possibility that if toner enters the guide portion 1*e*, each time the shutter is closed, the toner having entered the guide portion 1*e* is scraped toward the rear of the container, being collected at the rear, and eventually, and it becomes impossible to close the shutter. On the contrary, when the guide portion 1*e* is constituted of separate sections disposed with intervals, even if toner enters the guide portion 1*e*, it is discharged from the intervals, thereby being prevented from heaping up at the rear. Therefore, it is possible to avoid the occurrence of such a situation that a large amount of toner piles up at the rear and prevents the shutter from being closed.

[Welding of Seal Film 4 and Laminar Structure of Seal Film 4]

The seal film 4 is separably adhered to the peripheral edges of the toner discharge opening 1*d*. As to the adhering method, heat plate welding is most desirable, since it allows adhesion strength to be easily controlled, and also is excellent in productivity. In addition to the aforementioned heat plate welding, ultrasonic welding and impulse sealing may be also preferably used. Further, the seal film 4 may be adhered by coating adhesive or with the use of double sided adhesive tape.

As will be described later, in order to unseal the toner supply container, the seal film 4 is peeled off. As the seal film 4 is peeled, the top piece 2 of the shutter, around which the seal film 4 is wrapped, and the bottom piece 3 of the shutter, which is connected to the top piece 2 in the aforementioned manner, are pulled out at the same time. Therefore, the seal film 4 is required to have sufficient tensional strength, and also not to break off or tear as it is pulled out rubbing the edge of the top piece of the shutter. Further, it is required to be adherable to the toner supply container main portion 1, with the use of the aforementioned various means, and in addition, the adhesive strength must be proper. When heat plate welding is employed, it is most desirable that the seal film 4 is given the following laminar structure.

| | |
|---|---|
| First layer: | drawn polyester 16 μm |
| Second layer: | drawn nylon 25 μm |
| Third layer: | low density polyethylene 30 μm |
| Fourth layer: | sealant layer (ethylenevinyl acetate) 40 μm |

In addition to the above film, monoaxially stretched polypropylene film, biaxially stretched polypropylene film, unwoven polyethylene fabric, or the like, may be preferably used since they have sufficient strength, being unlikely to break. As for the overall thickness of the film, when it is insufficient, the film lacks strength and is liable to tear. On the contrary, when it is excessive, the film excessively gains in resiliency, creating problems as it is pulled out around the top piece 2 of the shutter. Therefore, the overall thickness of the film is desired to be in a range of 30–300 μm though it depends on the material and structure of the film; preferably, 50–200 μm; and most desirably, 80–130 μm.

The most desirable conditions for welding the seal film 4 to the toner supply container main body 1 formed on HI-PS, using heat plate welding, are that the temperature is approximately 160° C.; the duration is, approximately 3 seconds; and the pressure (surface pressure) is approximately 20 $kg/cm^2$.

[Top Piece 2 of Shutter]

The top piece 2 of the shutter functions to back up the adhered portion 4*a* of the seal film 4, and also functions to allow the toner discharge opening 1*d* to be easily closed to prevent a small amount of toner remaining in the container from spilling and soiling the surrounding areas after the toner supply container is used.

The seal film 4 is adhered to the peripheral edge of the toner discharge opening 1*d* using such a means as heat welding as described above, and in order to allow the seal film 4 to be peeled when unsealing the toner supply container, the adhesive strength must be controlled so that it does not become too strong. Therefore, the strength of the adhesion between the seal film 4 and the peripheral edge of the toner discharge opening 1*d* alone is not sufficient. For example, when the toner supply container is dropped during transportation, and the toner is caused to rush to the seal film 4 due to the impact, when the internal pressure of the toner supply container is increased in a high temperature environment or a low pressure environment, or when the like situations occurs, the adhered portion of the seal film 4 is liable to be lifted or peeled. In order to prevent the occurrence of such an incidence, the top piece 2 of the shutter is disposed extremely close to the seal film 4 to back up the seal film 4 against the aforementioned impact or internal pressure. Therefore, the top piece 2 of the shutter is required to have a sufficient degree of rigidity for the back-up task. Thus, the thickness of the top piece 2 of the shutter is desired to be set to be no less than 1.5 mm, and preferably, no less than 2.5 mm. In this embodiment, it is 2.5 mm.

[Bottom Piece 3 of Shutter]

The bottom piece 3 of the shutter is joined with the top piece 2 of the shutter in a manner to confine the seal film 4. When the seal film 4 is pulled out, the bottom piece 3 of the shutter keeps the film surface, to which toner is adhering, completely covered, so that the top surface of the hopper lid is prevented from being soiled by the toner adhering to the seal film 4.

Thus, the bottom piece 3 of the shutter is not required to have as much rigidity-as the top piece 2 of the shutter. As for the thickness of the bottom piece 3, a thickness of no less than 1.0 mm is sufficient; and preferably, no less than 1.5 mm. In this embodiment, it is 1.5 mm.

The folded portion 4*b* of seal film 4 is inserted between the top piece 2 and the bottom piece 3 of the shutter. When the insertion occurs, the surface of the sealant layer of the seal film 4 faces the bottom piece 3 of the shutter. When left in a hot and humid environment, the sealant layer of the seal film 4 is liable to adhere to the member it faces, causing problems when unsealing the container. In order to prevent this, it is desirable that the surface of the bottom piece 3 of the shutter, which faces the seal film 4, should be rendered rough with the provision of minute peaks and valleys. These peaks and valleys can be easily formed by providing the die with a wrinkled surface.

[Joining of Top and Bottom Pieces 2 and 3 of Shutter]

The top piece 2 and bottom piece 3 of the shutter have only to be integrally and solidly joined. As for the joining means, thermal crimping, ultrasonic crimping, as well as a method in which bosses are pressed in, may be preferably employed, but joining by snap fitting is most desirable.

Snap fitting allows the toner supply container to be easily assembled even without using apparatuses, jigs, or the like, and also allows the toner supply container to be relatively easily disassembled. Therefore, not only can snap fitting reduce manufacturing costs, but also it is convenient for remanufacturing them after recovering the used toner supply containers.

The details of the snap fit structure will be illustrated in FIGS. 5(*a*) and 5(*b*). As the claws 3*a* of the bottom piece 3 of the shutter engage the holes 2*a* of the top piece 2 of the shutter, the top piece 2 and bottom piece 3 of the shutter are joined. The combination of the claw 3 and the corresponding hole 2 is disposed at several locations, and the their numbers are determined depending on the length of the shutter.

As described above, these top and bottom pieces are 1.5–2.5 mm in thickness, being relatively thin, and therefore, do not necessarily afford a sufficient space for accommodating the snap fit structure. It is particularly difficult to increase the engagement margin d for the claws 3*a*. Therefore, in order to prevent the claws 3a from becoming disengaged due to the impact which occurs when the toner supply container is transported, or due to an internal pressure increase, it is desirable that a means for preventing disengagement should be provided. Thus, the bottom piece 3 of the shutter is provided with a rib 3*b*, on the area where the claw 3*a* is not positioned, and the top piece 2 of the shutter is provided with a rib 2*b* which extends across the entire length thereof. These ribs 2*b* and 3*b* are disposed to come in contact with each other when the top piece 2 and the bottom piece 3 are snap fitted. With the provision of this arrangement, even when the toner supply container is subjected to impact or the like, the claw 3*a* is not allowed to move in the direction to disengage from the hole 2*a* because the ribs 2*b* and 3*b* are in contact with each other. Therefore, disengagement is prevented.

It should be noted here that the top piece 2 and bottom piece 3 of the shutter may be formed as a single piece component comprising the two pieces 2 and 3 which are connected with a thin portion. In this case, the bottom piece 3 is folded over by bending the thin portion, and the edges opposite to the thin portion are joined with the use of one of the aforementioned various methods.

[Assembly of Shutter and Seal Film]

Methods for assembling the top piece 2 and bottom piece 3 of the shutter, and the seal film 4, will be described with reference to FIG. 2. There are two assembly methods for them.

[First Method]

First, the top piece 2 of the shutter is fitted all the way into the guide portion 1*e* of the toner supply container main body 1 to which the seal film 4 has been thermally welded. Next, the seal film is doubled over all the way to the front in a manner to wrap the top piece 2 of the shutter. Then, the bottom piece 3 of the shutter is securely snap fitted, from above, with the top piece 2 of the shutter, confining the seal film 4.

[Second Method]

First, the top piece 2 and bottom piece 3 of the shutter are snap fitted together. Next, the united top and bottom pieces 2 and 3 of the shutter are inserted into the guide portion 1*e* of the toner supply container main body 1 to which the seal film 4 has been thermally welded. At the same time, the seal film 4 is pushed through the gap between the top and bottom pieces 2 and 3 of the shutter, completing the assembly.

In order to cause the snap fit structure to reliably function, and prevent the seal film 4 from being pinched by the snap fit structure, the second method is preferable. However, in terms of automating the assembly, the first method is advantageous.

[Structure of Hopper]

Figure 6:
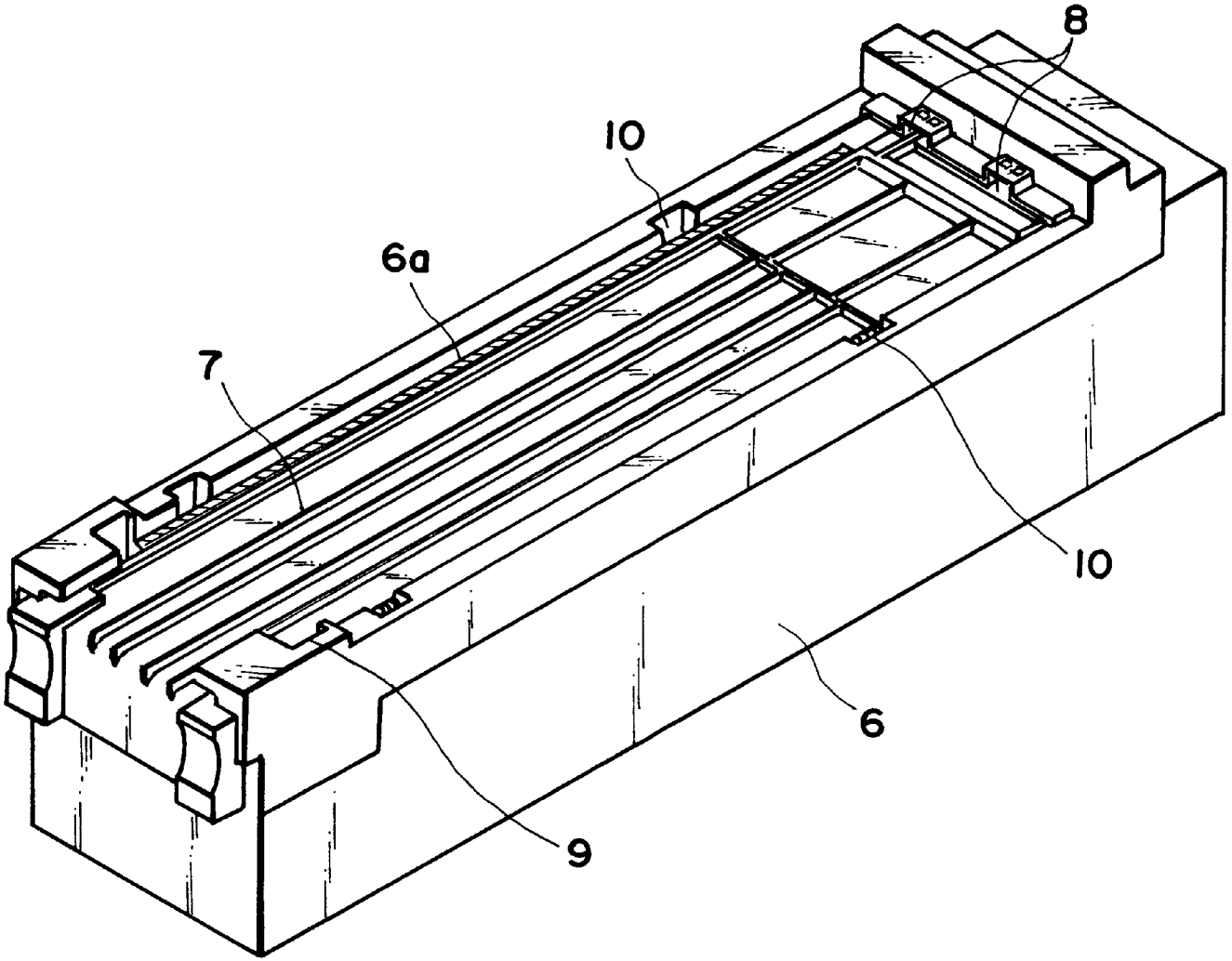
FIG. 6 is an external perspective view of the toner hopper to which the toner supply container is fitted to supply it with toner.

FIG. 6 is an external perspective view of the hopper in accordance with the present invention, into which the toner supply is poured. The toner supply container in this embodiment is mounted on this hopper. In FIG. 6, a reference numeral 6 designates a toner vessel; 7 denotes, hopper lid; 8 denotes, a first lock mechanism; 9 denotes, a second lock mechanism; and a reference numeral 10 designates a pop-up mechanism.

The hopper lid 7 is attached to the toner vessel 6. It is freely opened or closed, but is rendered unopenable by the first and second lock mechanisms unless the toner supply container is in engagement with the hopper. The peripheral edge of the opening of the hopper vessel 6 is provided with a seal member 6*a* so that the joint between the mounted toner supply container and the hopper vessel 6 can be kept airtightly sealed to prevent toner from scattering when the toner supply container is unsealed.

[Structure of First Lock Mechanism]

Figure 7:
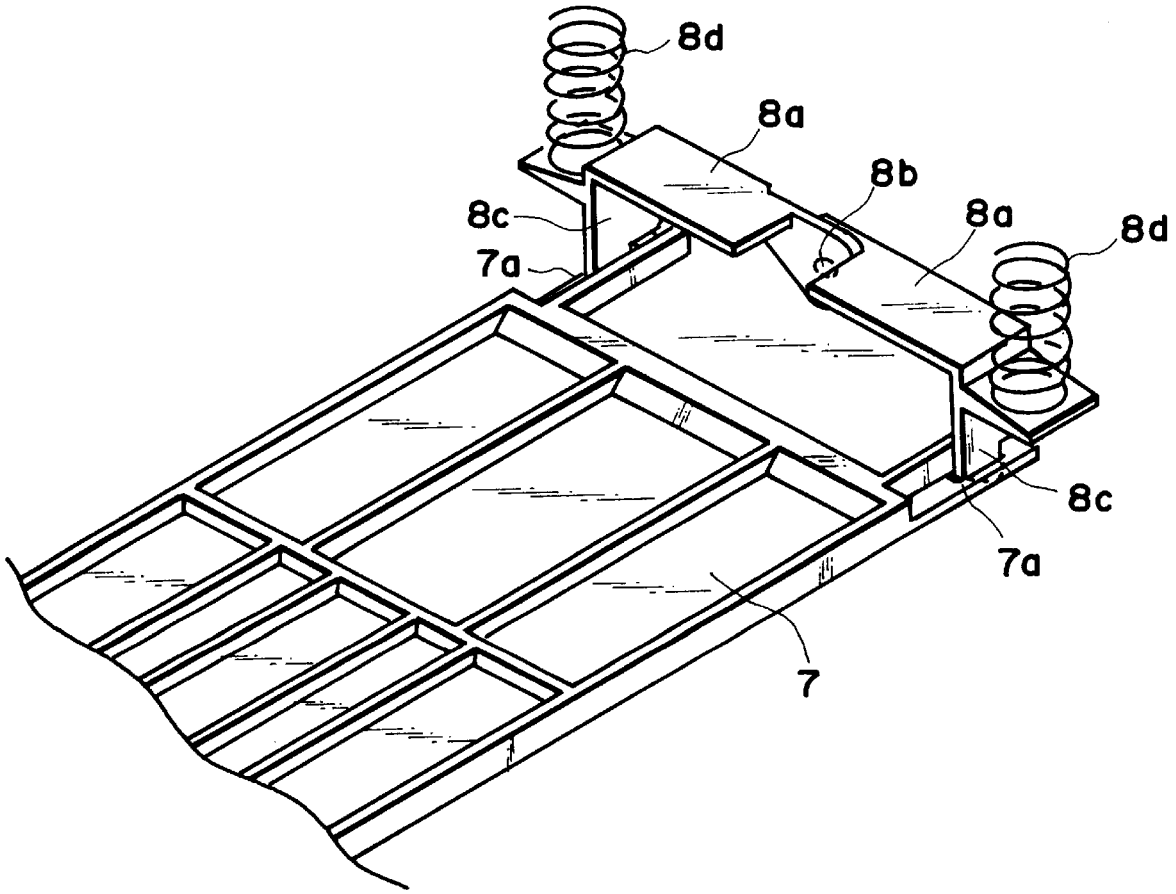
FIG. 7 is an external perspective view of a first lock mechanism 8.
Figure 8A:
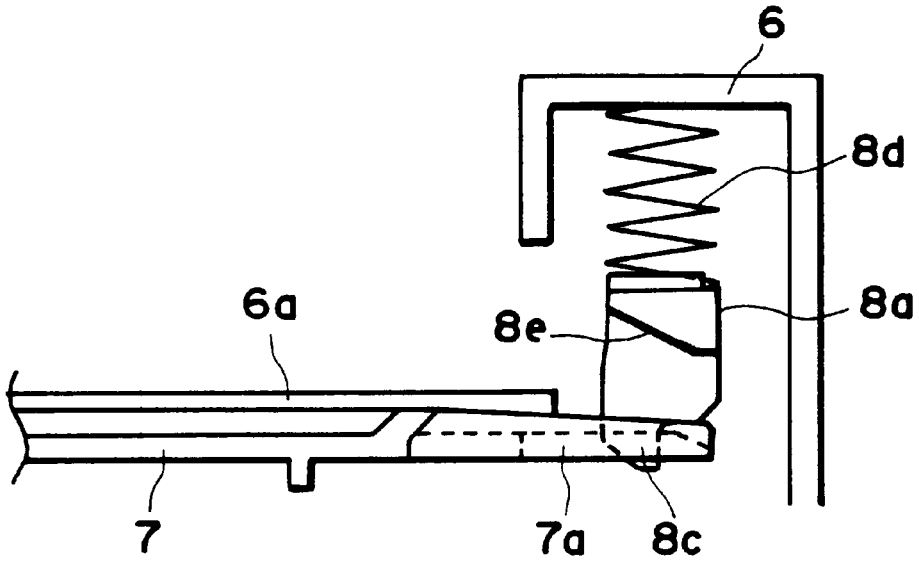
FIGS. 8(*a*) and 8(*b*) are side and front views, respectively, of the first lock mechanism in the locked state.
Figure 8B:
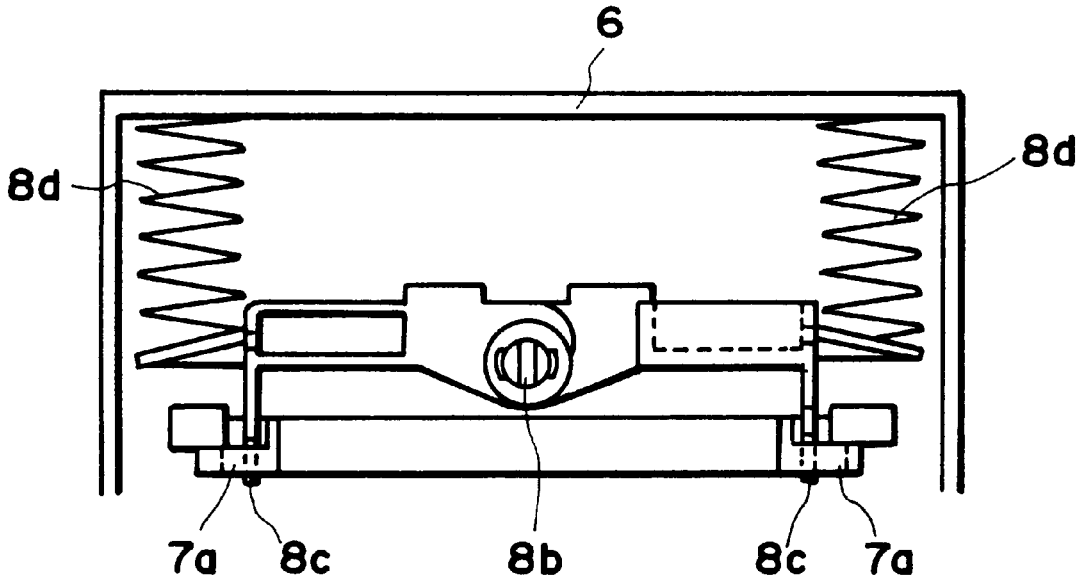
Figure 9A:
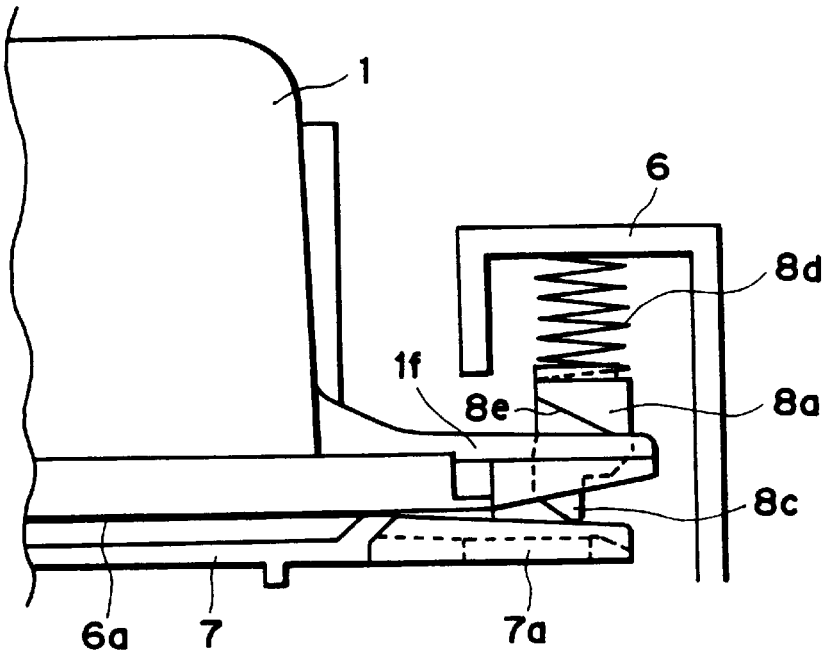
FIGS. 9(*a*) and 9(*b*) are side and front views, respectively, of the first lock mechanism in the unlocked state.
Figure 9B:
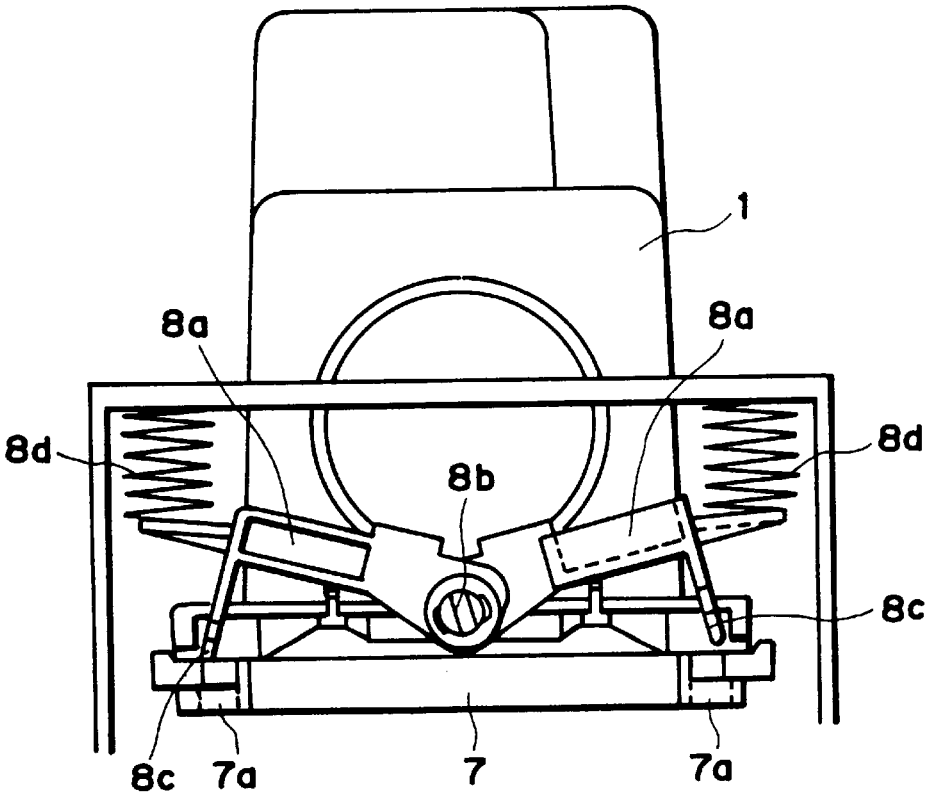

FIG. 7 is an external perspective view of the first lock mechanism 8. FIG. 8(*a*) is a side view of the locked first lock mechanism 8, and FIG. 8(*b*) is a front view thereof. FIG. 9(*a*) is a side view of the disengaged first lock mechanism 8, and FIG. 9(*b*) is a front view thereof.

In these drawings, a reference numeral 7*a* designates a hole provided at the tip of the hopper lid; 8*a* denotes, a lock arm; 8*b* denotes, a shaft of the lock arm 8*a*; 8*c* denotes, the claw of the lock arm 8*a*; 8*d* denotes an elastic member (coil spring); and a reference numeral 8*e* designates the slanted surface.

There are a pair of lock arms 8*a*, a right one and a left one. They are rotatively mounted on the shaft 8. The lock arm 8*a* is under the downward pressure from the elastic member (coil spring) 8*d*, and the claw 8*c* engages with the hole 7*a* of the hopper lid 7 to lock the hopper lid 7, that is, to prevent the hopper lid 7 from being pulled out (FIGS. 7 and 8).

[Operation of First Lock Mechanism]

As the toner supply container 1 is mounted on the hopper 6, the aforementioned lock is disengaged. In order to mount the toner supply container 1 on the hopper 6, first, the rear end tip of the first lock disengagement projection 1*f* is inserted into the first lock mechanism 8. This causes the top surface of the inserted tip of the first lock disengagement projection 1*f* to slide underneath the slanted surface 8*e*, that is, the downward facing surface, of the lock arm 8*a*, lifting the lock arm 8*a* against the pressure of the elastic member (coil spring) 8*d*. The pair of the right and left lock arms 8*a* are rotated upward about the shaft 8*b*, whereby the claws 8*c* are pulled out of the holes 7*a* of the hopper lid 7, disengaging the lock.

When the lock is in the disengaged state, the resiliency of the elastic member (coil spring) 8*d* is applied to the first lock disengagement projection 1*f* by way of the lock arm 8*a*, pressing the toner supply container 1 downward. As a result, the toner supply container 1 is placed in contact with the seal member 6*a* of the hopper 6, airtightly sealing the joint between the toner supply container 1 and the hopper 6.

[Structure of Second Lock Mechanism]

Figure 10A:
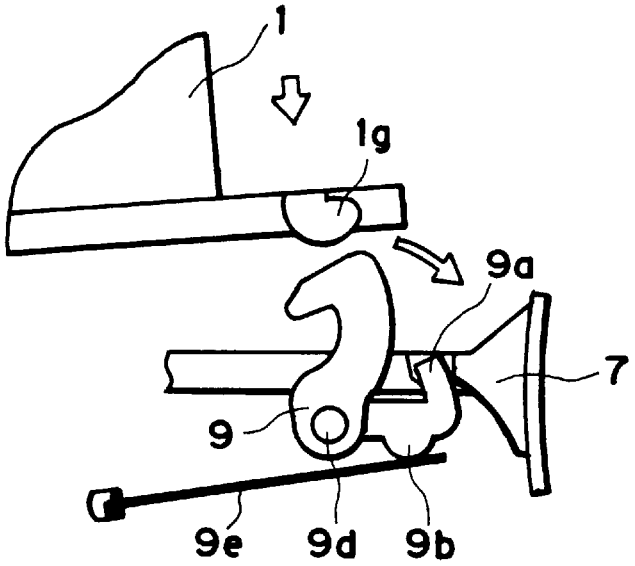
FIGS. 10(*a*), 10(*b*) and 10(*c*) are side views of a second locking mechanism, depicting the structure and operation thereof.
Figure 10B:
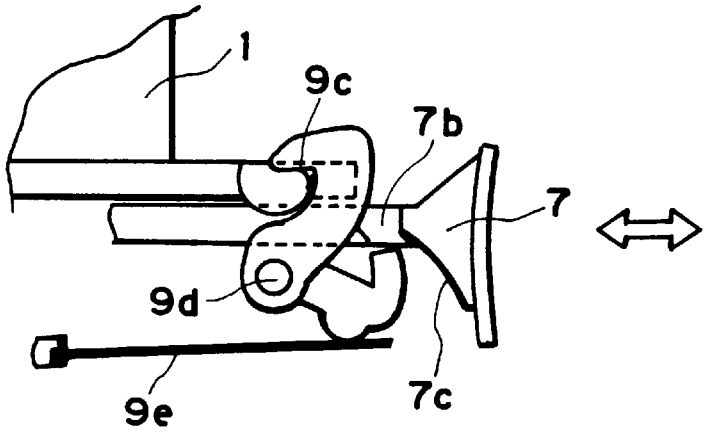
Figure 10C:
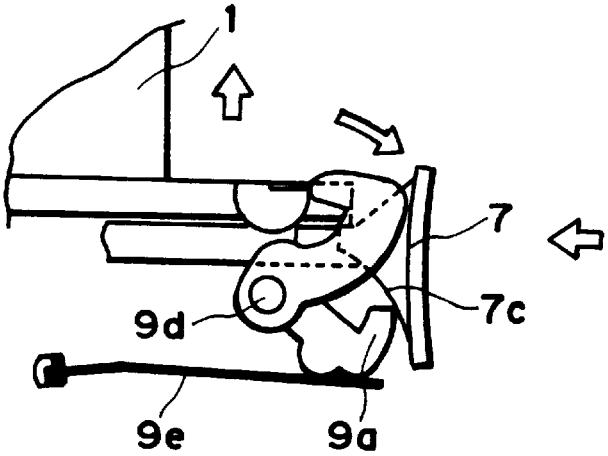

FIGS. 10(*a*), 10(*b*) and 10(*c*) are side views of the structure of the mechanism of the second lock, and depict the operation of the second lock. In the drawings, a reference numeral 7*b* designates a slit; 7*c* denotes, a slanted surface; 9*a* denotes, a claw portion; 9*b* denotes, a projection; 9*c*denotes a claw portion; 9*d* denotes the rotational center of the second lock member; and a reference numeral 9*e* designates an elastic member (leaf spring).

Referring to FIG. 10(*a*), the second lock member 9 is under the counterclockwise pressure as the projection 9*b* is pressed by the elastic member (leaf spring) 9*e* As a result, the claw portion 9*a* engages with the slit 7*b*, locking the hopper lid 7, that is, preventing the hopper lid 7 from being pulled out.

[Operation of Mechanism of Second Lock]

As the toner supply container 1 is mounted on the hopper 6, the lock member 9 is rotated about the rotational center 9*d* by the second lock disengagement projection 1*g*, in the direction of an arrow mark in FIG. 10(*a*) (clockwise), against the elastic member (leaf spring) 9*e*. As a result, the claw portion 9*c* of the second lock member 9 engages with the level portion of the second lock disengagement projection 1*g* as shown in FIG. 10(*b*), locking the toner supply container 1, that is, preventing the toner supply container from being removed.

As the lock member 9 is rotated, the claw 9*a* integral with the lock member 9 is rotated at the same time. As a result, while the toner supply container 1 is locked onto the hopper lid 7 as shown in FIG. 10(*b*), the engagement between the claw portion 9*a* and the slit 7*b* of the hopper lid 7 is broken, enabling the hopper lid 7 to be pulled out.

In order to remove the toner supply container, it is only necessary to push in the hopper lid 7 in the leftward direction from the position depicted in the FIG. 10(*a*). As the hopper lid 7 is pushed in, the slanted surface (tapered portion) 7*c* of the hopper lid 7 pushes the claw portion 9*a* of the second lock member 9, and therefore, the second lock member 9 is rotated in the direction of an arrow mark in FIG. 10(*c*) (clockwise), against the elastic member (leaf spring) 9*e*. As a result, the engagement between the claw portion 9*a* and the second lock disengagement projection 1*g* is broken, enabling the toner supply container 1 to be removed. When the hopper 6 is provided with a pop-up mechanism 10, which will be described later, the toner supply container 1 is automatically lifted up by a predetermined distance as soon as the engagement is broken.

After the toner supply container 1 is removed, the state depicted by FIG. 10(*a*) is restored by the resiliency of the elastic member (leaf spring) 9*e*.

[Toner Refilling Step]

Figure 11:
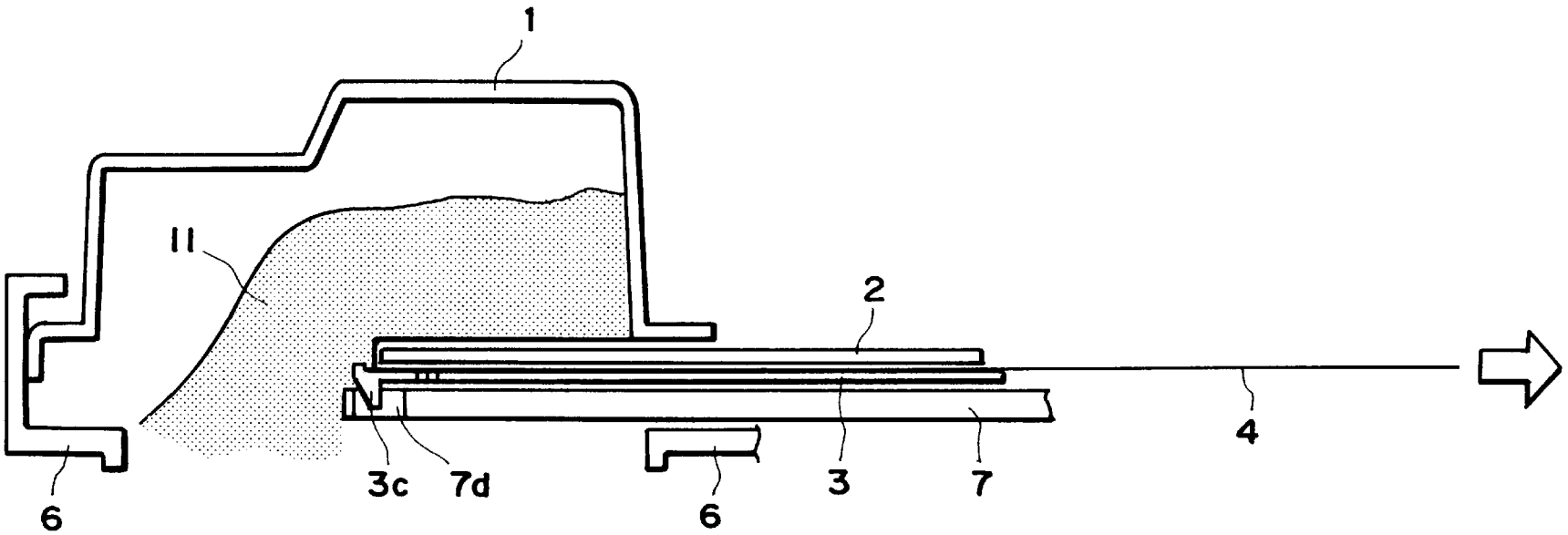
FIG. 11 is a sectional drawing depicting how the toner supply container is fitted with the hopper, how the seal film is peeled, and how the toner is fitted into the hopper.
Figure 12:
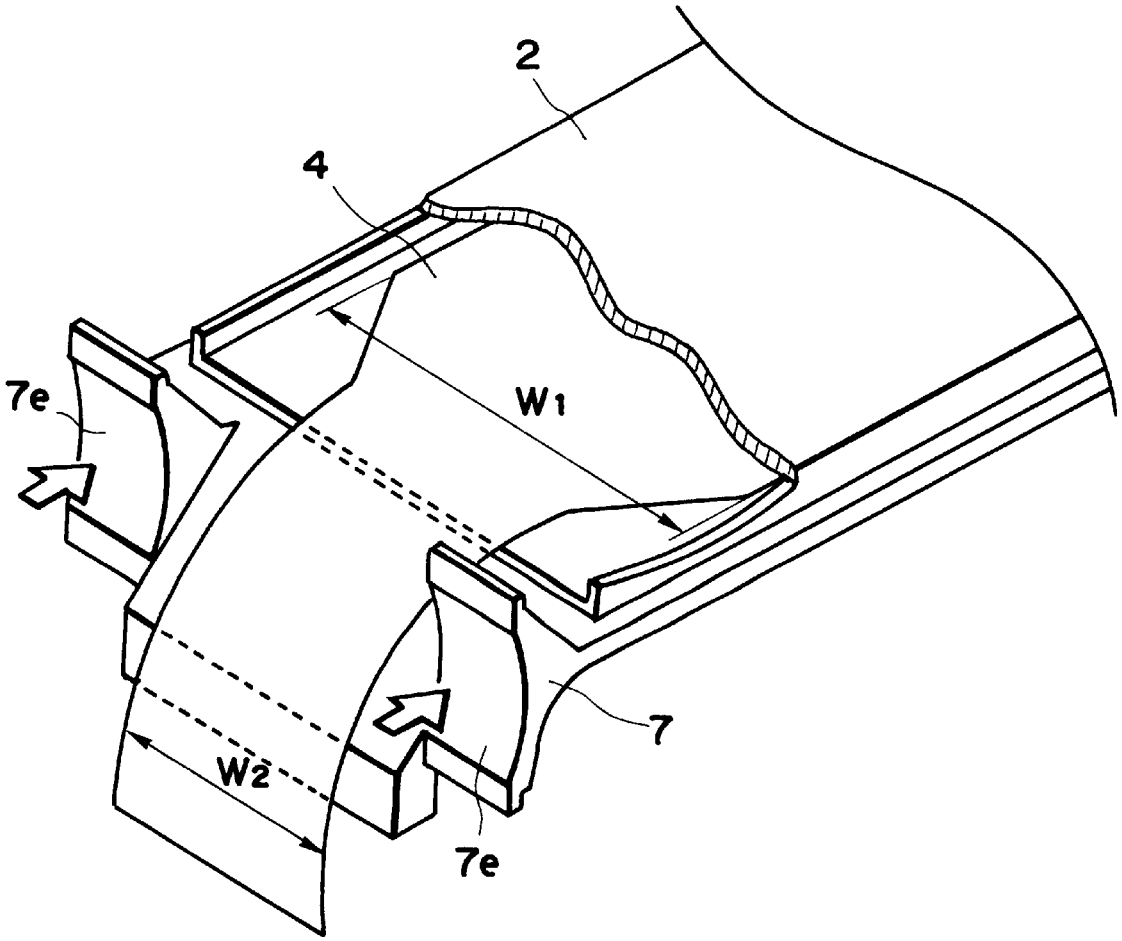
FIG. 12 is a perspective drawing depicting the state of the front side of the joint between the toner supply container and the hopper at the time when the toner refilling container is unsealed.

FIG. 11 is a section of the toner supply container, which has been mounted on the hopper 6, and has been unsealed to supply the hopper 6 with toner. FIG. 12 is a perspective drawing depicting the front side of the joint between the toner supply container 1 and the hopper 6 at the time when the toner supply container is unsealed. In the drawings, a reference numeral 3*c* designates a projection provided on the bottom surface of the bottom piece 3 of the shutter; 7*d* denotes, the contact surface at the tip portion of the hopper lid 7; 7*e* denotes a knob of the hopper lid 7; and a reference numeral 11 designates toner. The steps for supplying the hopper 6 with toner will be described with reference to these drawings. It should be noted here that in these drawings, the first and second lock mechanism, and the pop-up mechanism have been omitted.

First, the toner supply container 1 is mounted on the hopper 6. When mounting the toner supply container 1, the back side (left side in the drawings) of the toner supply container 1 is lowered first and inserted into the first lock mechanism (unillustrated) of the hopper 6. Next, the front side (right side in the drawings) of the toner supply container 1 is placed into the second lock mechanism (unillustrated) of the hopper 6 by rotating the toner supply container 1 about the inserted back side of the toner supply container 1 in the clockwise direction of the drawings. Thus, both the first and second lock mechanisms are caused to act on the toner supply container 1. As a result, the toner supply container 1 is locked in, being preventing from being removed from the hopper 6, and enabling the hopper lid 7 to be pulled out.

Next, the seal film 4 is pulled toward the front side (right direction of the drawing, that is, the direction indicated by the arrow in the drawing), by the front end side of the folded portion of the seal film 4. As the seal film 4 is pulled, the adhered portion of the seal film 4 is peeled away, and at the same time, the top piece 2 of the shutter, on which the seal film 4 is folded over, and the bottom piece 3 of the shutter, which is integrally joined with the top piece 2, follow the movement of the seal film 4, being thereby pulled out. Further, the projection 3*c* provided on the bottom surface of the bottom piece 3 of the shutter engages with the contact surface 7*d* of the tip portion of the hopper lid 7, whereby hopper lid 7 is also pulled out. In other words, a single action of pulling out the seal film 4 causes the seal film 4 to be pulled out, the top and bottom pieces 2 and 3 of the shutter to be opened, and the hopper lid 7 to be opened, at the same time, allowing the toner 11 stored in the toner supply container 1 to be discharged into the toner vessel of the hopper 6.

As the toner supply container 1 is unsealed, the folded portion 4*b* of the seal film 4 is pulled out through the gap between the top and bottom pieces 2 and 3 of the shutter, and the portion 4*b* of the seal film 4, which is adhered to the flange of the toner supply container 1, is pulled into the gap between the top and bottom pieces 2 and 3 of the shutter, preventing the toner adhering to the seal film 4 from transferring to the top surface of the hopper lid 7; the top surface of the hopper lid 7 is prevented from becoming soiled by the toner adhering to the seal film 4, and the portion 4*a* of the seal film 4, which is soiled with the toner, will never be seen by the operator.

Referring to FIG. 12, as for the width of the seal film 4, the portion 4*a*, which is attached to the flange portion 1*b*, has a width of W2, being wider than the toner discharge opening 1*d*, but the folded portion 4*b*, which is to be pulled out, has a width of W2, being narrower than the width W1. This width W2 is small enough to allow the seal film 4 to pass between the knobs 7*e* disposed apart from each other in a direction perpendicular to the direction in which the hopper lid 7 is pulled out.

After the completion of toner discharge, the hopper lid 7 is closed by pushing the two knobs 7*e* of the hopper lid 7 in the direction indicated by the arrow marks in FIG. 12. At this time, the seal film 4 is passed between the two knobs 7*e* and is pulled back into the gap between the top and bottom pieces 2 and 3 of the shutter. Since the aforementioned projection 3*c* provided on the bottom surface of the bottom piece 3 of the shutter is in engagement with the contact surface 7*d* of the tip portion of the hopper lid 7, the hopper lid 7, and the top and bottom pieces 2 and 3 of the shutter, are moved together in the closing direction.

As the hopper lid 7 is closed all the way, the second lock mechanism is actuated to disengage itself from the toner supply container 1, enabling the toner supply container 1 to be removed. At the same time, the toner supply container 1 is rotated in the counterclockwise direction of the drawing, about a point adjacent to the first lock mechanism on the back side, and is lifted up a predetermined distance, by the pop-up mechanism, which will be described later. Next, as the toner supply container 1 becomes disengaged from the second lock mechanism, the hopper lid 7 is locked by the second lock mechanism, and therefore, cannot be pulled out.

As described above, as the toner supply container 1 is mounted on the hopper 6, it is immediately and automatically locked onto the hopper 6, and as the hopper lid 7 is pushed into the lock disengaging position after the toner supply container 1 is unsealed and toner is discharged, the toner supply container 1 becomes removable. Normally, the hopper lid 7 is locked to prevent it from being pulled out, is enabled to be pulled out as the toner supply container 1 is mounted, and is locked again as the toner supply container 1 is removed.

[Pop-up Mechanism]

FIG. 13 is a perspective view of the pop-up mechanism in this embodiment. FIG. 14 is a sectional drawing depicting the operational movement of the pop-up mechanism. In the drawings, a reference numeral 1*i* designates a projection; 10*a* denotes a notch; and a reference numeral 10*b* designates an elastic member (leaf spring).

During the process (FIG. 10) of engaging the second lock disengagement projection 1*g* with the second lock mechanism 9 by mounting the toner supply container 1 on the hopper 6 and pressing the toner supply container 1 from above (FIG. 10), the projection 1*a* of the toner supply container 1 presses down the elastic member 10*b* disposed in the notch 10*a* of the hopper 6, causing the elastic member (leaf spring) 10*b* to elastically deform as shown in FIG. 14(*b*). Therefore, as the toner supply container is set on the hopper 6 to supply the hopper 6 with toner, the toner supply container 1 is subjected to the force from the elastic member (leaf spring) 10*b*, which acts on the toner supply container 1 in a manner to lift it by rotating it about a point adjacent to the aforementioned first lock disengagement projection 1*f*. But, as long as the second lock mechanism 9 remains engaged with the second lock disengagement projection 1*g*, that is, as long as the toner supply container 1 is locked in, being prevented from being removed, the aforementioned rotational lifting of the toner supply container 1 is prevented.

However, as soon as the hopper lid 7 is pushed in to the lock disengagement position, and therefore, the engagement between the second lock mechanism 9 and the second lock disengagement projection 1*g* is broken, the toner supply container 1 is automatically lifted in a rotational motion from the mounting position by the resiliency of the elastic member (leaf spring) 10*b* illustrated in FIG. 14(*b*). Since the toner supply container 1 is automatically displaced from the mounting position, the operator can confirm the disengagement of the lock. Then, the operator has only to grasp the toner supply container 1 having been automatically displaced, and remove it from the hopper 6.

[Seal Structure and Contamination]

Next, the seal structure will be described with reference to FIG. 9. The joint between the toner supply container 1 and the hopper 6 is airtightly sealed by the seal member 6*a*, which is pinched by the toner supply container 1 and the hopper 6. The material for the seal member 6*a* is desired to be elastic material, preferably, foamed polyethylene, foamed polypropylene, foamed polyurethane, or the like. The most desirable material is moderately foamed polyurethane having a specific weight of 0.2–0.5 since it is less likely to be permanently deformed by compression, and therefore, can remain resilient for a long time.

As described above, while the toner supply container 1 is on the hopper 6, it receives constant upward pressure from the elastic member (leaf spring) 10*b* of the pop-up mechanism. This is not desirable in terms of the airtightness provided by the seal member 6*a*. In other words, the seal member 6*a* is liable to be loosened. However, downward pressure is applied to the toner supply container 1 by the elastic member (coil spring) 8*d* of the first lock mechanism 8, through the first lock disengagement projection 1*f*, and this force keeps the toner supply container 1 airtightly in contact with the seal member 6*a* against the aforementioned upward pressure. Thus, toner is prevented from leaking out while the toner supply container 1 is unsealed and the toner is discharged.

[Toner Filling Test]

Before the toner was filled into the toner hopper, the toner supply container was shaken 50 times to properly mix the toner with air so that the bulk density of the toner is rendered low to improve the fluidity of the toner. Then, it is immediately mounted on the hopper 6, and unsealed, but the toner did not leak.

Immediately afterward, the same toner supply container 1 was shaken 50 more times, and the toner was immediately discharged into the hopper 6 (so-called second filling). Also in this case, the toner did not leak.

[Maintenance of Engagement Between Bottom Piece 3 of Shutter and Hopper Lid 7]

Referring to FIG. 11, when the toner supply container 1 mounted on the hopper 6 is unsealed or resealed, the bottom piece 3 of the shutter and the hopper lid 7 must move together. This is accomplished by the engagement between the projection 3*c* provided on the bottom surface of the bottom piece 3 of the shutter, and the engagement surface 7*d* of the tip portion of the hopper lid 7. The dimension of the engagement area (in the vertical direction) is regulated by various factors, such as the thickness of the hopper lid 7, and most of the time, it cannot be rendered as large as it is desired to be. Generally, it is in a range of 1.5–5.0 mm. In this embodiment, it is 2.0 mm.

Also in this case, the presence of the upward pressure from the elastic member (leaf spring) 10*b* of the pop-up mechanism 10 is not desirable in terms of the maintenance of the engagement between the bottom piece 3 of the shutter and the hopper lid 7, since the presence of such pressure is liable to loosen the engagement. However, downward pressure is applied to the toner supply container 1 from the elastic member (coil spring) 8*d* of the first lock mechanism 8, through the first lock disengagement projection 1*f*, and the engagement between the bottom piece 3 of the shutter and the hopper lid 7 is maintained against the aforementioned upward pressure by this downward pressure. Therefore, it is possible to prevent such an accident as the disengagement between the bottom piece 3 of the shutter and the hopper lid 7, which occurs when the toner supply container 1 is unsealed, or when the hopper lid 7 is closed.

[Elimination of Toner Supply Container Inter-changeability]

As described before, the number of cases in which toners of different types are fitted in toner supply containers of the same type, has been increasing. Toner supply containers of several different types, which are not interchangeable, can be produced by varying the position, the length, the configuration, or the like, of the first lock disengagement projection 1*f*.

When an attempt is made to mount a toner supply container of a different type, that is, a toner supply container noninterchangeable with the original container, even if the second lock member on the front side can be disengaged, the first lock member at the rear cannot be disengaged. Therefore, the hopper lid 7 cannot be opened. In other words, it is possible to provide further improved noninterchangeability.

[Back Wall Configuration of Toner Supply Container and Toner Distribution in Hopper]

As described before, the ceiling wall of the toner supply container 1 is rendered lower on the first lock disengagement projection side (rear side), and higher on the second lock disengagement projection side (front side).

When mounting the toner supply container 1 on the hopper 6, the first lock disengagement projection 1*f* is first inserted into, and engaged with, the first lock member 8. During this process, the toner supply container 1 is tilted, the rear side being lower than the front side. Therefore, the toner stored in the toner supply container 1 tends to shift to the rear. However, since the height of the toner supply container 1 is less on the rear side than on the front side, and therefore, the internal volume of the toner supply container 1 is less on the rear side than on the front side, the toner is prevented from shifting to the rear by an excessive amount.

As the front side of the toner supply container 1 is lowered in a manner to rotate the toner supply container 1 about the rear side of the toner supply container 1, the second lock disengagement projection 1*g* is engaged with the second lock mechanism 9. In this state, a relatively large amount of the toner is on the rear side, leaving a relatively small amount of the toner on the front side.

As the toner supply container 1 is unsealed by pulling the seal film 4, the unsealing of the toner supply container 1 occurs from the rear side and progresses toward the front side. Since the toner distribution within the toner supply container 1 is biased as described above, the toner does not pile up on the front side of the hopper 6; the toner is relatively evenly filled into the hopper 6.

It is desirable that the height of the ceiling of the toner supply container 1 on the rear side is set to be less than the effective depth of the hopper 6. With such an arrangement, the toner does not heap on the rear side in any case. The above mentioned effective depth means the distance from the top edge of the toner vessel of the hopper 6 to the top surface of the toner remaining in the hopper 6 when it is detected that the toner supply in the hopper 6 is insufficient. In other words, the effective depth of hopper 6 refers to the depth of the space in which the toner can be actually filled.

If the second lock disengagement projection 1*g* on the front side is first engaged with the second lock mechanism, the toner supply container 1 becomes tilted in the undesirable manner. In other words, the front side is rendered lower than the rear side, and therefore, the toner shifts to the area with the greater ceiling height, which is undesirable. However, in this case, the first lock cannot be disengaged, and therefore, the hopper lid 7 cannot be pulled out to supply the hopper 6 with the toner. In other words, there is no other way but remounting the toner supply container 1 following a correct mounting procedure, and as the toner supply container 1 is properly mounted, the toner shifts to the area with the less ceiling height, allowing the toner to be evenly supplied into the hopper 6. After all is said, the fact that there are two lock mechanisms, and the lock disengagement projections must be actuated following the regulated procedure renders this mounting method reliable.

As for the ratio between the dimensions of the hopper section with the lower ceiling and the hopper section with the higher ceiling in the vertical direction of the toner supply container 1, it has only to be determined in consideration of the factors, such as the amount of the toner to be filled, the hopper configuration, the effective hopper volume, and the like. Generally speaking, it is desirable that the section with the higher ceiling is larger by 10–50%, preferably, by 30%, in vertical dimension than the section with the lower ceiling. As for the ratio between the dimensions of the two sections in the longitudinal direction of the toner supply container 1, it is desired to be set in a range of 3:7–7:3, preferably, at 1:1.

[Force Necessary to Mount Toner Supply Container]

As for the procedure for mounting the toner supply container 1 on the hopper 6, which was described before, first, the rear side of the toner supply container 1 is lowered, and inserted into the first lock mechanism. Next, the front side of the toner supply container 1 is engaged with the second lock mechanism in a manner to rotate the toner supply container 1 about the engaged portions of the front side of the toner supply container 1 and the first lock mechanism. As a result, both the first and second lock mechanisms are engaged to enable the hopper lid 7 to be pulled out, and also to unremovably lock the toner supply container 1 onto the hopper 6.

The force necessary for the above-described sequence of operations was measured. The force necessary to engage the first lock disengagement projection 1*f* with the first lock mechanism 8 of the hopper 6 (FIGS. 8 and 9 ) was in a range of 0.5 kgf–1.5 kgf, which amounts to a substantially negligible load.

The force necessary to engage the second lock disengagement projection 1*g* of the toner supply container 1 with the second lock mechanism 9 of the hopper 6 was in a range of 1.0 kgf–2.0 kgf. This is slightly higher than the aforementioned force necessary for the operation to engage the first lock mechanism, but this operation required nothing but pressing down the ceiling of the toner supply container 1 from above, making it easier to apply the force, and therefore, the required force was at a level which was manageable without strain.

[Force Necessary to Unseal Toner Supply Container]

The procedure to unseal the toner supply container 1 is as follows. As the folded portion of the seal film 4 is pulled toward the front side, the adhered section of the seal film 4 is peeled away, and at the same time, the top piece 2 of the shutter, around which the seal film 4 wraps, and the bottom piece 3 of the shutter, which is integrally joined with the top piece 2, are pulled out as the seal film 4 is peeled away. Further, the projection 3*c* provided on the bottom surface of the bottom piece 3 of the shutter engages with the contact surface 7*d* of the tip portion of the hopper lid 7, whereby the hopper lid 7 is also pulled out. As a result, both the toner supply container I and the toner hopper 6 are opened.

In other words, a single action of pulling out of the seal film 4 causes the seal film 4 to be peeled, the top and bottom pieces 2 and 3 of the shutter to be opened, and the hopper lid 7 to be opened, all at once.

When the force necessary for this action was measured, the largest force was needed at the initial stage, which was in a range of 2.7 kgf–6.0 kgf, and the force necessary during the intermediate and last stages was in a range of 0.6 kgf–2.0 kgf. The force of 6.0 kgf, which was necessary at the initial stage of pulling, was thought to cause slight strain, but was considered sufficiently small in practical usage. The following is an itemized list of the forces.

Peeling of seal film 4 (initial stage): 2.5–4.0 kgf

Peeling of seal film 4 (middle to end stages) 0.4–1.0 kgf

Movement of top and bottom pieces of shutter: 0.1–1.0 kgf

Movement of hopper lid: 0.1–1.0 kg

As described before, the moment the toner supply container 1 is mounted on the hopper 6, the toner supply container 1 is unremovably locked onto the hopper 6, and therefore, it remains securely fixed to the toner supply container 1, and thereby, to the main assembly of the image forming apparatus (unillustrated) even when the toner supply container 1 is unsealed. Therefore, when the force necessary to be applied to the toner supply container 1 is at the level described above, the toner supply container 1 can be smoothly unsealed without apprehension.

As described above, according this embodiment of the present invention, the moment the toner supply container 1 is mounted, the hopper lid 7 is disengaged from the locking mechanism, and the shutter and the hopper lid are opened as the seal film is peeled. Therefore, the toner can be filled through only two actions, that is, mounting and unsealing, and also, the force necessary to mount or unseal the toner supply container is reduced to a level which causes no problem in practical usage. In addition, since the toner supply container is unremovably locked onto the hopper 6 the moment it is mounted, the unsealing operation can be remarkably reliably carried out.

Further, since the lock mechanism for the hopper lid is provided on both the rear and front sides, the hopper lid is completely disengaged from the lock mechanisms only after the toner supply container is securely mounted. Also, since the toner supply container is unremovably locked onto the hopper the moment the toner supply container is mounted on the hopper, reliability in terms of toner leakage is greatly improved.

Moreover, the engagement between the bottom piece 3 of the shutter and the hopper lid 7 can be reliably maintained.

[Comparative Example of Toner Supply Container]

Figure 15:
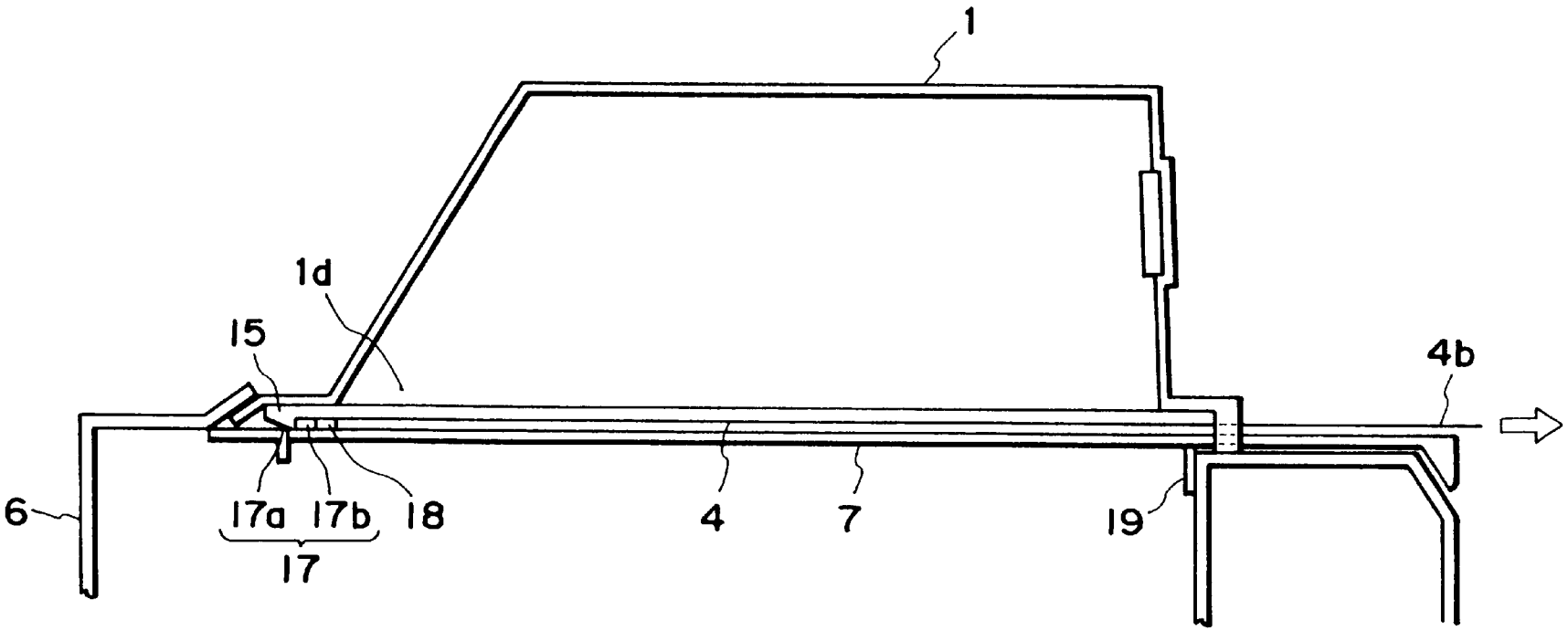
FIG. 15 (PRIOR ART)
FIG. 15 is a cross-sectional drawing depicting the sealed condition of a comparative toner filling system.
Figure 16:
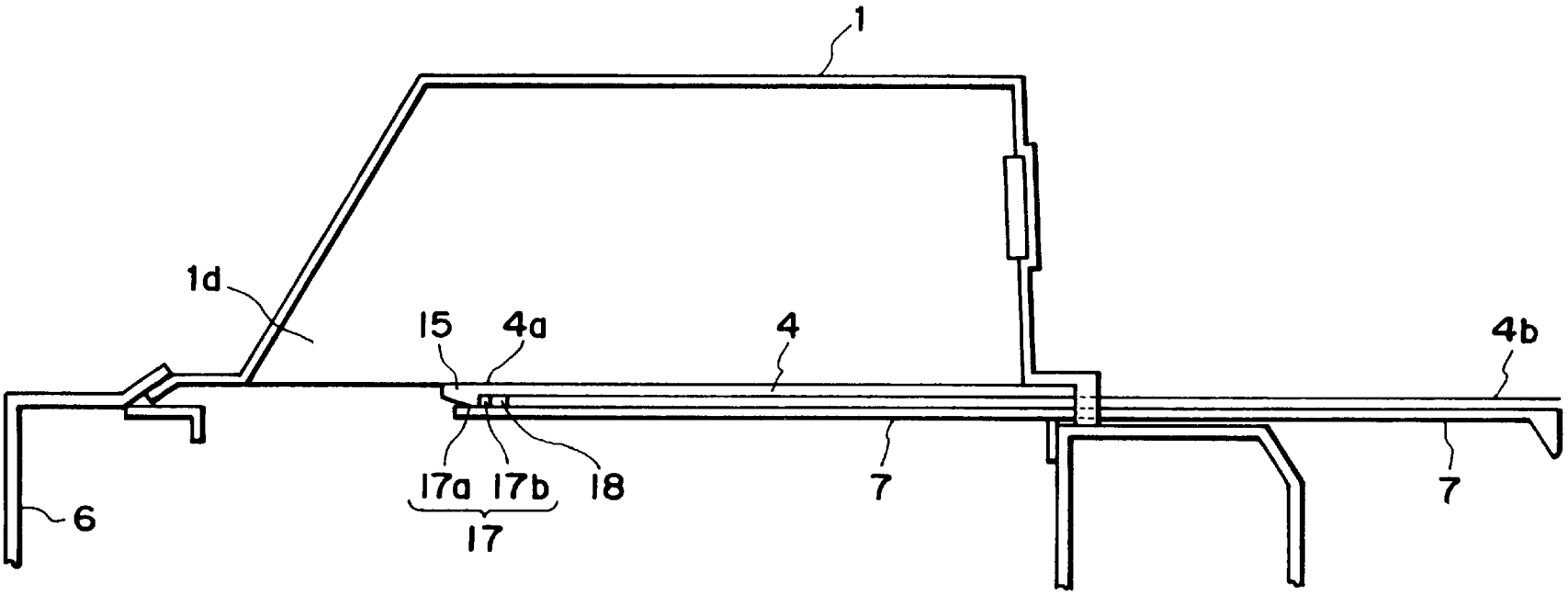
FIG. 16 (PRIOR ART)
FIG. 16 is a cross-sectional drawing depicting the partially opened comparative toner filling system.
Figure 17:
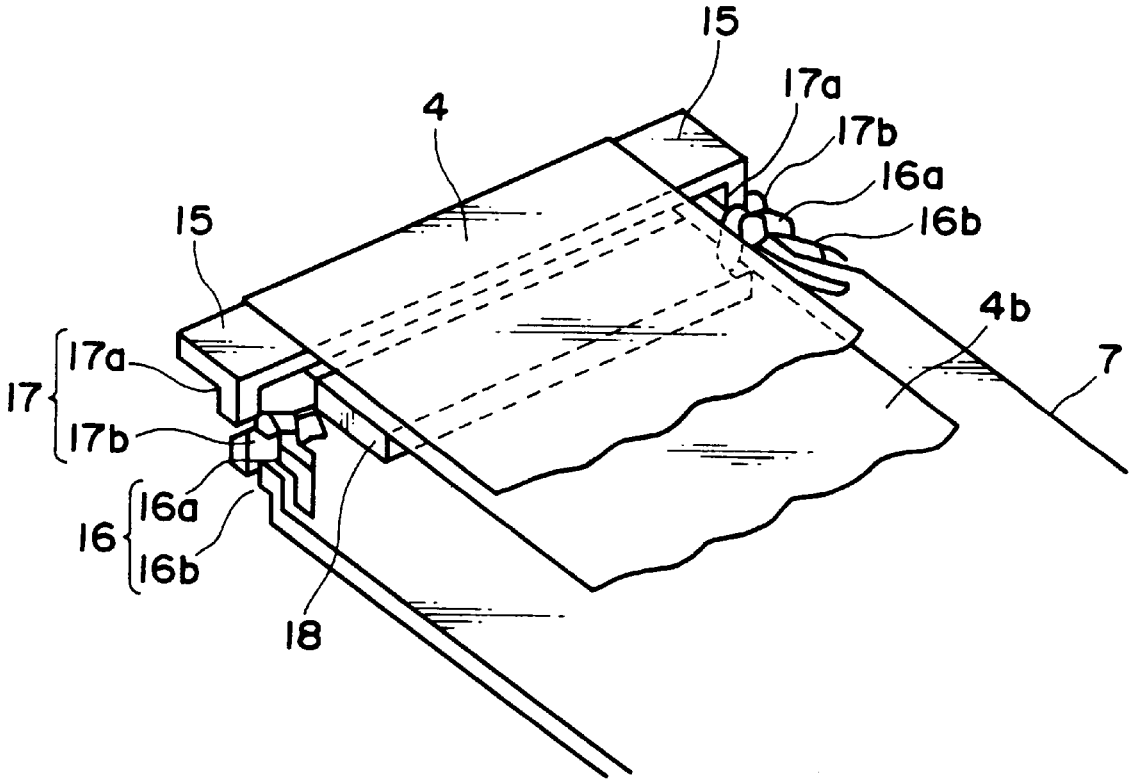
FIG. 17 (PRIOR ART)
FIG. 17 is a perspective drawing depicting the relationship between the lock mechanism, and the unlocking means, of the comparative toner filling mechanism.

FIG. 15 is a longitudinal section of an airtightly sealed comparative system for filling a toner supply. FIG. 16 is a longitudinal section of the unsealed comparative system for filling toner supply. FIG. 17 is a perspective drawing depicting the relationship between the lock mechanism and the lock disengaging means, of the comparative toner supply container. In the drawing, the sections identical to those in the preceding embodiment are designated by the same reference symbols.

The hopper lid 7 is slidably attached to the hopper 6 so that it can be freely opened or closed. The toner supply container 1 is removably mounted on the hopper 6. In order to seal the toner discharge opening 1*d* of the toner supply container 1, the seal film 4 is peelably adhered, and approximately one half of the seal film 4, which is not adhered, is folded back. In the folding line portion of the seal film 4, a sliding member 15 is disposed, which slides in the sliding direction of the hopper lid 7 as the seal film 4 is peeled.

Referring to FIG. 17, a lock mechanism 16 which engages with the hopper lid 7 when the hopper lid 7 is in the closed state is provided along with a disengaging means 17 for disengaging the lock mechanism 16. The disengagement of the lock mechanism 16 is linked to the peeling of the seal film 4.

Also referring to FIG. 17, the lock mechanism 16 comprises elastic hooks 16*a*, and projections 16*b*. The hook 16*a* is disposed on the right and left ends of the rear edge of the hopper lid 7, and is rotatively flexible in the right or left direction about its base portion. The projection 16*b* is disposed on the rear end portion of the wall of the hopper 6, and disengageably engages with the corresponding hook 16*a*.

On the other hand, the disengaging means 17 is a means for rotatively flexing the hooks 16*a* about their base portions in the corresponding directions (left or right direction). It comprises the engagement claws 17*a* of the sliding member 15, and cylindrical projections 17*b* which are integrally formed on the hook 16*a*, and remain engaged with the engagement claw 17*a* while the hopper lid 7 is in the closed state. It should be noted here that the relationship among the hook 16*a*, the engagement claw 17*a*, and the projection 17*b* is such that while the lock mechanism 16 is in the engaged state, the center of the projection 17*b* is more inwardly located than the inward edge of the engagement claw 17*a*, and as the engagement claw 17*a* comes in contact with the projection 17*b*, the hook 16*a* is inwardly flexed about its base portion.

Next, the movements of the lock mechanism 16 and disengagement means 17 in the above structure will be described. As the toner supply container 1 is mounted on the hopper 6, and the seal film 4 is peeled out, during the toner fill operation, the sliding member 15 within the folding line portion of the seal film 4 is moved to the right from the position illustrated in FIG. 15, causing the projection 17*b* of the hopper lid 7 to be pushed by the engagement claw 17*a* of the sliding member 15, and also causing the hook 16*a* to be inwardly flexed about its base portion. As a result, the hook 16*a* becomes disengaged from the projection 16*b* (lock is disengaged), and the hopper lid 7 is moved to the right, allowing the toner to be discharged into the hopper 6, as shown in FIG. 16.

After the toner is filled into the hopper 6, the sliding member 15 and the seal film 4 are returned to their original positions as the hopper lid 7 is closed. As the hook 16*a* comes in contact with the projection 16*b*, the hook 16*a* inwardly deforms due to its configuration and elasticity, and clears the projections 16*b*, finally engaging with the projection 16*b* (lock mechanism 16 is engaged).

Referring to FIG. 17, a rectangular first cleaning member 18 for cleaning the toner which adheres to the seal film 4 as the toner comes in contact with the seal film 4 is attached to the hopper lid 7. It is located at the rear side of the hopper lid 7, more inwardly than the projection 17*b*. Further, a second cleaning member 19, which comes in contact with the back side of the hopper lid 7 to clean the toner adhering to the back side of the hopper lid 7, is pasted to the front side of the hopper 6.

When unsealing the toner supply container 1, the seal film 4 and the hopper lid 7 rub against the first and second cleaning members 18 and 19, respectively, to clear the adhering toner and prevent the cleared toner from scattering.

When the force necessary to unseal the comparative toner supply container was measured, the largest force was necessary at the initial stage of the unsealing action, which was in a range of 4.1 kgf –7.5 kgf. The force necessary during the middle to the last stage was in a range of 2.0 kgf–5.5 kgf. This meant that the force necessary at the initial stage created a substantial amount of load. In particular, the maximum value of 7.5 kgf measured at the initial stage seemed to be too high for one hand operation. The following is an itemized list of the measurements.

Peeling of seal film 4 (initial stage): 2.5–4.0 kgf
Peeling of seal film 4 (middle to end stage) 0.4–1.0 kgf
Movement of sliding member 15: 0.1–1.0 kgf
Disengagement of lock mechanism 16: 0.5–1.5 kgf
Movement of hopper lid 7: 0.1–2.0 kg (Inclusive of Sliding of First and Second Cleaning Members)

As described above, in the case of a conventional toner supply container, the operation for unsealing the toner supply container by peeling the seal film 4 doubles as the operation for disengaging the lock mechanism 16 of hopper lid 7, and also, the seal film 4 and hopper lid 7 rub against the corresponding cleaning members; therefore, the force necessary for the unsealing operation increases, causing a deterioration in operational efficiency. The stage in which the force necessary for the unsealing operation becomes largest is the initial stage, and in the initial stage, that is, immediately after the toner supply container 1 is mounted on the hopper 6, the toner supply container 1 is yet to be locked in. In other words, the operation which requires the large amount of force must be carried out while the engagement between the toner supply container 1 and the hopper 6 is extremely instable, which worsens the operational efficiency.

[Embodiment 2]

Figure 18:
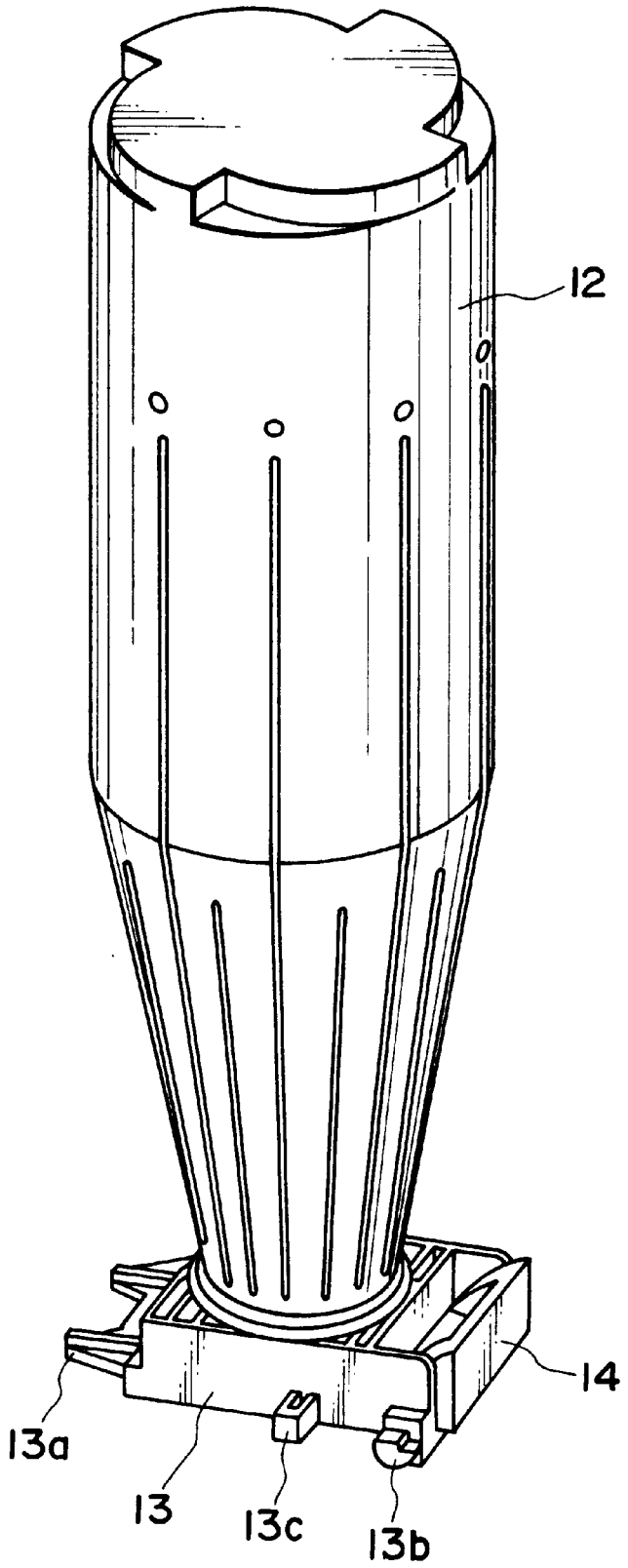
FIG. 18 is a perspective view of the toner supply container in another embodiment of the present invention.

FIG. 18 is a perspective view of the toner supply container in another embodiment of the present invention. In the drawing, a reference numeral 12 designates a bottle constituting the main body of the toner supply container; 13 denotes, a cap; and a reference numeral 14 designates a shutter. The rearward facing surface of the cap 13 is provide with a pair of first lock disengagement projections 13*a*, and the lateral walls of the cap 13 are provided with-a second lock disengagement projection 13*b*, which is located on the front side, and the projection 13*c*, which is located substantially in the middle. The projection 13*c* engages with the pop-up mechanism. These projections are integrally formed with the cap 13.

On the top surface of the shutter 14 (surface facing the bottle), a packing (unillustrated) formed of slightly foamed polyurethane or the like is pasted. The shutter 14 is inserted into the cap 13. After the shutter 14 is inserted into the cap 13, the cap 13 is attached to the bottle by screwing or the like means, completing the toner supply container.

Also in the case of this second embodiment, the structure of the hopper (unillustrated), and the method for mounting the toner supply container on the hopper, are exactly the same as those described in the first embodiment. First, the first lock disengagement projection 13*a* is inserted into the first lock mechanism of the hopper. Next, the front side of the toner supply container is lowered by rotating the toner supply container about the inserted portion of the toner supply container, and then, the second lock disengagement projection 13*b* is engaged with the second lock member to complete the operation for mounting the toner supply container. During this operation, the projection 13*c* is subjected to the upward pressure from the elastic member of the pop-up mechanism.

Next, as for the method for unsealing the toner supply container, this is slightly different from the one described in the first embodiment. As the toner supply container is mounted, and the first and second lock mechanisms are disengaged, it becomes possible to pull out the hopper lid (unillustrated), and also, the toner supply container is unremovably locked in. Next, the hopper lid is pulled out. Then, the shutter 14 is pulled out to unseal the toner supply container, allowing the toner stored in the bottle 12 to be discharged into the hopper. After the discharging of the toner is completed, the shutter 14 is pushed in to close the toner supply container. Next, the hopper lid is pushed in to be close the hopper. Then, the toner supply container is disengaged from the lock mechanisms. As a result, the projection 13*c* is pushed up by the pop-up mechanism; the toner supply container is automatically rotated about its rear side, being raised by a predetermined distance. Thus, the toner supply container becomes removable again.

Also in the case of the second embodiment, operational effects are the same as those described in the first embodiment. When the force necessary for the unsealing operation was measured, the initial stage of opening the shutter 14 required the largest force as expected, which was in a range of 2.5 kgf–4.5 kgf, and the middle and end stages required a force ranging from 0.5 kgf to 2.5 kgf. According to these results, the load is slightly high in the initial stage, but the maximum value of 4.5 kgf is less than that in the first embodiment, and is safely in a practical load range, providing satisfactory operational efficiency. The list of the measurements is as follows.

Pulling of hopper lid: 2.0–4.0 kgf

Opening of shutter 14 (initial stage): 2.5–4.5 kgf

Opening of shutter 14 (middle and end stages): 0.5–2.5 kgf

Since the toner supply container is unremovably locked onto the hopper the moment the toner supply container is mounted on the hopper, and remains securely fixed to the hopper as well as the main assembly of the image forming apparatus (unillustrated) even during the operation for unsealing the toner supply container, as described above. Therefore, the necessary forces are within the above ranges, and the operation for unsealing the toner supply container can be smoothly carried out without any apprehension. This characteristic is the same as that of the first embodiment.

While the invention has been described with reference to the structures disclosed herein, it is not confined to the details set forth and this application is intended to cover such modifications or changes as may come within the purposes of the improvements or the scope of the following claims.

What is claimed is:

1. A toner supply container to be set to a supply portion having a hopper opening for a toner hopper, a hopper shutter member for opening and closing the hopper opening, and locking means for locking the hopper shutter member, said toner supply container comprising:

a toner container body for accommodating toner and having a supply opening for supplying the toner;

a seal member for sealing the supply opening;

a releasing projection for releasing locking of said hopper shutter member by said locking means, in response to a setting operation to the supply portion; and interrelating means, engagable with said hopper shutter member below a movement path of said seal member for interrelating movement of said hopper shutter member upon removal of said seal member and said seal member when said toner supply container is set to the supply portion.

2. The toner supply container according to claim 1, wherein said toner supply container has a flange portion for forming the supply opening, and said releasing projection is provided on the flange portion.

3. A toner supply container to be set to a supply portion having a hopper opening for a toner hopper, a hopper shutter member for opening and closing the hopper opening, and locking means for locking the hopper shutter member, said toner supply container comprising:

a toner container body for accommodating toner and having a supply opening for supplying the toner;

a seal member for sealing the supply opening;

a releasing projection for releasing locking of said hopper shutter member by said locking means, in response to a setting operation to the supply portion;

interrelating means for interrelating movement of said hopper shutter member and said seal member when said toner supply container is set to the supply portion; and a container shutter member for opening and closing the supply opening, wherein said interrelating means is provided on a bottom surface of said container shutter member and said interrelating means is engagable with said hopper shutter member and moves by pulling said seal member when said toner supply container is set to the supply portion.

4. The toner supply container according to claim 3, wherein said container shutter member includes an upper plate and a lower plate, between which said seal member is extended, wherein said interrelating means is provided on a bottom surface of said lower plate.

5. The toner supply container according to claim 3, wherein said toner supply container has a gasket for sealing between said container shutter member and said toner supply container.

6. A toner supply mechanism comprising:

a toner hopper for storing toner;

a hopper opening for supplying toner into said toner hopper;

a hopper shutter member for opening and closing said hopper opening;

locking means for locking said hopper shutter member;

a toner supply container to be set to the hopper opening, wherein said toner supply container includes a supply opening for supplying the toner, and a seal member for sealing the supply opening;

releasing means for releasing locking of said locking means in response to setting of said toner supply container; and interrelating means engagable with said hopper shutter member below a movement path of said seal member for interrelating movement of said hopper shutter member upon removal of said seal member and said seal member when said toner supply container is set, and locking of said locking means is released.

7. A toner supply mechanism comprising:

a toner hopper for storing toner;

a hopper opening for supplying toner into said toner hopper;

a hopper shutter member for opening and closing said hopper opening;

locking means for locking said hopper shutter member;

a toner supply container to be set to the hopper opening, wherein said toner supply container includes a supply opening for supplying the toner, and a seal member for sealing the supply opening;

releasing means for releasing locking of said locking means in response to setting of said toner supply container; and an interrelating portion for interrelating movement of said hopper shutter member and said seal member when said toner supply container is set, and locking of said locking means is released, wherein said toner supply container includes a container shutter member, movable with said seal member, for opening and closing said supply opening, and the interrelating portion includes an engaging portion, provided on a bottom surface of said container shutter member, for engaging with said hopper shutter member.

8. A toner supply container mountable on a toner receiving apparatus having a toner passing opening, an apparatus shutter for opening and closing the toner passing opening, and a movable locking member, comprising:

a toner container for containing therein toner and having a toner supply opening;

a seal member being openable to open said toner supply opening;

a first locking member displacing portion for acting on the locking member to displace the locking member when said toner supply container is mounted on the toner receiving apparatus at a predetermined position;

a first lock engagement portion by which the locking member is engaged after the locking member is displaced by said locking member displacing portion; and an interrelating member, engagable with said apparatus shutter below a movement path of said seal member for interrelating movement of said apparatus shutter upon removal of said seal member and said seal member when said toner supply container is set to the toner receiving apparatus.

9. A toner supply container according to claim 8, further comprising a second locking member displacing portion and a second lock engagement portion, wherein said first locking member displacing portion comprises a first projection and said first lock engagement portion comprises a second projection.

10. A toner supply container according to claim 9, wherein said toner supply opening is elongated and said first and second projections are provided on opposite sides of said toner container with respect to a longitudinal direction of said elongated toner supply opening.

11. A toner supply container according to claim 8, wherein said toner supply container further comprises a protruding portion formed at one end of said toner container, said protruding portion being insertable into a recessed portion of the toner receiving apparatus and preventing movement of said one end relative to the toner receiving apparatus and preventing movement of said one end relative to the toner receiving apparatus when said toner supply container is mounted on the toner receiving apparatus.

12. A toner supply container according to claims 8, 9, 10, or 11, wherein said seal member comprises a flexible sheet that seals the toner supply opening and that can be pulled so as to peel the flexible sheet from the toner supply opening.

13. A toner supply container according to claim 12, wherein the seal member further comprises a container shutter slidably supported for movement across the toner supply opening between a first position in which the toner supply opening is covered and a second position in which the toner supply opening is exposed, the flexible sheet when peeled from the toner supply opening being foldable into engagement with the container shutter which is movable from its first position to its second position by pulling the flexible sheet, return of the container shutter from its second position to its first position recovering the toner supply opening with the flexible sheet still being secured to said toner container at an end portion thereof;

wherein said interrelating member is provided on a bottom surface of said container shutter.

14. A toner supply container according to claim 13, wherein the container shutter is formed with a cavity extending from one end of said container shutter to the other end parallel to the plane of said container shutter, said cavity for receiving the flexible sheet from the toner supply opening as the container shutter is moved to its second position.

15. A toner supply container according to claim 13, wherein said container shutter includes an upper plate and a lower plate, between which said flexible sheet is extended, wherein said interrelating member is provided on a bottom surface of said lower plate.

16. A toner supply container according to claim 13, wherein said toner supply container has a gasket for sealing between said container shutter and said toner container.

17. A toner supply container according to claim 9, wherein said toner supply container has a flange portion for forming the toner supply opening, and said projections are provided on the flange portion.

18. A toner supply container mountable on a toner receiving apparatus having a toner passing opening, an apparatus shutter for opening and closing the toner passing opening, and a movable locking member, comprising:

a toner container for containing therein toner comprising an elongated flange forming a toner supply opening, a pair of projections on the flange and a protruding portion formed at one end of the toner container, the protruding portion being insertable into a recessed portion of the toner receiving apparatus preventing movement of said one end relative to the toner receiving apparatus and preventing movement of said one end relative to the toner receiving apparatus when said toner supply container is mounted on the toner receiving apparatus, each projection being provided on opposite sides of said toner container with respect to a longitudinal direction of said toner supply opening;

a seal member including a flexible sheet that seals the toner supply opening and that can be pulled so as to peel the flexible sheet from the toner supply opening and a container shutter formed with a cavity extending from one end of the container shutter to the other end parallel to the plane of the container shutter, the container shutter including an upper plate and a lower plate between which the flexible sheet is extended, said container shutter being slidably supported for movement across the toner supply opening between a first position in which the toner supply opening is covered and a second position in which the toner supply opening is exposed, the flexible sheet when peeled from the toner supply opening being foldable into engagement with the container shutter which is movable from its first position to its second position by pulling the flexible sheet, return of the container shutter from its second position to its first position recovering the opening with the flexible sheet still being secured to said toner container at an end portion thereof, said cavity receiving the flexible sheet from the toner supply opening as the container shutter is moved to its second position;

a pair of locking member displacing portions for acting on the locking member to displace the locking member when said toner supply container is mounted on the toner receiving apparatus at a predetermined position, one of the pair of locking member displacing portions being provided on each of said projections;

a pair of lock engagement portions by which the locking member is engaged after the locking member is displaced by said pair of locking member displacing portions, one of the pair of lock engagement portions being provided on each of said projections; and an interrelating member provided on a bottom surface of said lower plate, engagable with said apparatus shutter below a movement path of said seal member for interrelating movement of said apparatus shutter upon removal of said seal member and said seal member when said toner supply container is set to the toner receiving apparatus, wherein a gasket provides sealing between the container shutter and the toner container.

19. A toner supply container engageable with a toner hopper having a hopper opening, a hopper lid covering the hopper opening, and first and second lock mechanisms locking the hopper lid against movement so that the hopper lid is locked to cover the hopper opening, said toner supply container comprising:

a container main portion comprising:

a toner storing portion having a toner filling opening and a cap for releasably sealing said toner filling opening; and a flange portion integral with said toner storing portion, said flange portion having:

a toner discharging opening for discharging toner stored in said toner storing portion; and a guide portion around said toner discharging opening; a shutter comprising:

a top piece; and a bottom piece comprising a laterally extending projection projecting from one end of the bottom surface thereof and engageable with a portion of said toner hopper when said toner supply container is mounted on the toner hopper, wherein said top piece and said bottom piece of said shutter are inserted into said guide portion and retained therein, wherein said bottom piece comprises a plurality of spaced apart claws positioned along each longitudinal edge of said bottom piece, each of which is snap-fitable into one of a plurality of spaced apart holes positioned along each longitudinal edge of said top piece, wherein said top and bottom pieces are slidable in said guide portion between a first position in which the toner discharging opening is covered and a second position in which the toner discharging opening is exposed, wherein said guide portion is substantially U-shaped, wherein said guide portion comprises a plurality of separate guide sections, separated by predetermined intervals across the entire length of said container main portion;

a seal film separably adhered to the peripheral edges of the toner discharging opening on said flange portion for releasable sealing the toner discharging opening, wherein one end of said seal film is folded back to wrap around said top piece of said shutter and extends from a front side of said container main portion, wherein said bottom piece of said shutter is positioned with respect to said top piece of said shutter to enclose the folded back portion of said seal film, wherein the folded back portion of said seal film is positioned between the top surface of said bottom piece of said shutter and the bottom surface of said top piece of said shutter, wherein the top surface of said bottom piece of said shutter is rough compared to the bottom surface of said top piece of said shutter, wherein unpeeling of said seal film by a user grasping the one end thereof extending from the front side of said container main portion when said toner supply container is mounted on said toner hopper, unpeels said seal film from the peripheral edges of the toner discharging opening and slides the top and bottom pieces of said shutter in said guide portion from said first position to said second position, thereby moving said laterally extending projection of said bottom piece, which engages a contact surface of the hopper lid of the toner hopper and moves the hopper lid to expose the hopper opening to permit toner from said toner supply container to enter the toner hopper when said toner supply container is mounted on the toner hopper;

a back-end pair of projections configured to disengage the first lock mechanism of the toner hopper when said toner supply container engages said toner hopper, wherein said back-end pair of projections is integral with the back end of said container main portion and said flange portion; and a front-end pair of projections configured to disengage the second lock mechanism of the toner hopper when said toner supply container engages said toner hopper, wherein said front-end pair of projections is integral with the front end of said flange portion of said container main portion, wherein one front-end projection is positioned at each lateral edge of said flange portion, wherein at least a portion of the bottom side of each front-end projection is slanted, wherein the top side of at least a portion of each front-end projection is flat, wherein said back-end pair of projections and said front-end pair of projections displace said first and second lock mechanisms of the toner hopper, respectively, to disengage the first and second lock mechanisms from the hopper lid of the toner hopper, and wherein said back-end pair of projections and said front-end pair of projections engage the first and second lock mechanisms, respectively, after displacing the first and second lock mechanisms so as to lock said toner supply container to the toner hopper, wherein said container main portion comprises a ceiling, wherein the portion of said ceiling closer to the back-end pair of projections is higher than the portion of the said ceiling closer to said front-end pair of projections, and wherein said top piece of said shutter is configured and positioned to back up the adhered portions of said seal film and to allow the toner discharging opening to be easily closed to prevent toner remaining in said container main portion from spilling out therefrom after the toner supply container is used.

20. A toner supply container engageable with a toner hopper, said toner supply container comprising:

a container main portion comprising:

a toner storing portion having a toner-filling opening and a releasable sealing cap on said toner filling opening; and a flange portion integral with said toner storing portion, said flange portion having:

a toner-discharging opening; and a guide portion around said toner discharging opening;

a shutter comprising:

a top piece; and a bottom piece comprising a laterally extending projection projecting from one end of the bottom surface thereof being configured to engage a portion of said toner hopper when said toner supply container is mounted on the toner hopper, said top piece and said bottom piece of said shutter being positioned in said guide portion and retained therein, said bottom piece comprising a plurality of spaced apart claws positioned along each longitudinal edge of said bottom piece, each of which is snap-fitable into one of a plurality of spaced apart holes positioned along each longitudinal edge of said top piece, said top and bottom pieces being configured to slide in said guide portion between a first position in which the toner-discharging opening is covered and a second position in which the toner-discharging opening is exposed, wherein said guide portion is substantially U-shaped, said guide portion comprising a plurality of separate guide sections, separated by predetermined intervals across the entire length of said container main portion;

a seal film separably adhered to the peripheral edges of the toner discharging opening on said flange portion and configured to releasable cover the toner discharging opening, one end of said seal film being folded back to wrap around said top piece of said shutter and extending from a front side of said container main portion, said bottom piece of said shutter being positioned with respect to said top piece of said shutter to enclose the folded back portion of said seal film, the folded back portion of said seal film being positioned between the top surface of said bottom piece of said shutter and the bottom surface of said top piece of said shutter, the top surface of said bottom piece of said shutter being rough compared to the bottom surface of said top piece of said shutter, said one end of said seal film extending from the front side of said container main portion being graspable by a user and being unpeelable by a user from the peripheral edges of the toner discharging opening, wherein said top and bottom pieces of said shutter are configured to slide in said guide portion from said first position to said second position in response to unpeeling of said seal film by the user, a back-end pair of projections configured to contact a first lock mechanism of the toner hopper when said toner supply container engages said toner hopper, wherein said back-end pair of projections is integral with the back end of said container main portion and said flange portion; and a front-end pair of projections configured to contact a second lock mechanism of the toner hopper when said toner supply container engages said toner hopper, said front-end pair of projections being integral with the front end of said flange portion of said container main portion, one front-end projection being positioned at each lateral edge of said flange portion, at least a portion of the bottom side of each front-end projection being slanted, at least a portion of the top side of each front-end projection being flat, and said container main portion further comprising a ceiling, wherein the portion of said ceiling closer to the back-end pair of projections is higher than the portion of the said ceiling closer to said front-end pair of projections.

* * * * *

UNITED STATES PATENT AND TRADEMARK OFFICE

CERTIFICATE OF CORRECTION

PATENT NO. : 5,974,286

DATED : October 26, 1999

INVENTOR(S) : Yutaka BAN et al.

It is certified that error appears in the above-identified patent and that said Letters Patent is hereby corrected as shown below:

ON THE COVER PAGE:

AT FOREIGN PATENT DOCUMENTS, Item [56]

"0 102 002 3/1994" should read --0 102 002 3/1984--.

COLUMN 3:

Line 23, "and" should read --and a--.

COLUMN 4:

Line 9, "transported-or" should read --transported or--.
Line 32, "described-later," should read --described later,--; and "if" should read --1f--.

UNITED STATES PATENT AND TRADEMARK OFFICE

CERTIFICATE OF CORRECTION

PATENT NO. : 5,974,286

DATED : October 26, 1999

INVENTOR(S) : Yutaka BAN et al.

It is certified that error appears in the above-identified patent and that said Letters Patent is hereby corrected as shown below:

COLUMN 7:

Line 25, "is," should read --is--.
Line 48, "occurs" should read --occur--.
Line 50, "incidence," should read --incident,--.
Line 67, "rigidity-as" should read --rigidity as--.

COLUMN 9:

Line 28, "denotes," should read --denotes--; and "hopper" should read --a hopper--.
Line 29, "denotes," (both occurrences) should read --denotes--.
Line 48, "denotes," should read --denotes--.
Line 49, "denotes," (both occurrences) should read --denotes--.

UNITED STATES PATENT AND TRADEMARK OFFICE

CERTIFICATE OF CORRECTION

PATENT NO. : 5,974,286

DATED : October 26, 1999

INVENTOR(S) : Yutaka BAN et al.

It is certified that error appears in the above-identified patent and that said Letters Patent is hereby corrected as shown below:

COLUMN 10:

Line 17, "denotes," should read --denotes--.
Line 18, "denotes," (both occurrences) should read --denotes--; and "9cde-" should read --9c de- --.
Line 24, "9e" should read --9e.--.

COLUMN 11:

Line 5, "denotes," should read --denotes--.

COLUMN 15:

Line 61, "I" should read --1--.

COLUMN 16:

Line 11, "kg" should read --kgf--.
Line 22, "this" should read --to this--.

UNITED STATES PATENT AND TRADEMARK OFFICE

CERTIFICATE OF CORRECTION

PATENT NO. : 5,974,286

DATED : October 26, 1999

INVENTOR(S) : Yutaka BAN et al.

It is certified that error appears in the above-identified patent and that said Letters Patent is hereby corrected as shown below:

COLUMN 18:

Line 5, "kg" should read --kgf--.
Line 30, "denotes," should read --denotes--.
Line 31, "provide" should read --provided--.

COLUMN 19:

Line 3, "be" should be deleted.
Line 31, "above." should read --above,--.
Line 32, "Therefore," should be deleted.

COLUMN 23:

Line 56, "releasable" should read --releasably--.

COLUMN 24:

Line 46, "higher" should read --lower--.

UNITED STATES PATENT AND TRADEMARK OFFICE

CERTIFICATE OF CORRECTION

PATENT NO. : 5,974,286

DATED : October 26, 1999

INVENTOR(S) : Yutaka BAN et al.

It is certified that error appears in the above-identified patent and that said Letters Patent is hereby corrected as shown below:

COLUMN 25:

Line 13, "snap-fitable" should read --snap-fittable--.
Line 28, "releasable" should read --releasably--.

COLUMN 26:

Line 35, "higher" should read --lower--; and "the" (second occurrence) should be deleted.

Signed and Sealed this

Twelfth Day of December, 2000

*Attest:*

Q. TODD DICKINSON

*Attesting Officer*

*Director of Patents and Trademarks*